US007026925B2

(12) United States Patent
Roche et al.

(10) Patent No.: US 7,026,925 B2
(45) Date of Patent: Apr. 11, 2006

(54) DISASTER RECOVERY VIRTUAL ROLL CALL AND RECOVERY MANAGEMENT SYSTEM

(75) Inventors: Robert Roche, Nagoya (JP); Eric Hladilek, Nagoya (JP); Scott Reid, Nagoya (JP)

(73) Assignee: Oak Lawn Marketing, Inc., Naka-Ku (JP)

( * ) Notice: Subject to any disclaimer, the term of this patent is extended or adjusted under 35 U.S.C. 154(b) by 358 days.

(21) Appl. No.: 10/158,313

(22) Filed: May 30, 2002

(65) Prior Publication Data

US 2003/0197615 A1 Oct. 23, 2003

(30) Foreign Application Priority Data

Apr. 23, 2002 (JP) ..... 2002-120886

(51) Int. Cl.
*G08B 1/00* (2006.01)

(52) U.S. Cl. ..... 340/531; 340/539.11; 340/539.13; 340/539.16; 340/539.17; 340/573.4; 340/600; 340/601; 455/404.1; 455/404.2; 455/456.3

(58) Field of Classification Search ..... 340/539.11, 340/539.13, 539.16, 539.17, 573.4, 600, 340/601; 455/404.1, 404.2, 456.3
See application file for complete search history.

(56) References Cited

U.S. PATENT DOCUMENTS 5,091,930 A * 2/1992 Shapiro ..... 379/39
5,369,699 A * 11/1994 Page et al. ..... 379/38
5,742,233 A 4/1998 Hoffman et al.
5,835,907 A * 11/1998 Newman ..... 707/10
6,002,748 A * 12/1999 Leichner ..... 379/48
6,028,514 A 2/2000 Lemelson et al.
6,262,666 B1 7/2001 Lodichand
6,442,241 B1 * 8/2002 Tsumpes ..... 379/45
6,509,833 B1 * 1/2003 Tate ..... 340/539.1
6,563,910 B1 * 5/2003 Menard et al. ..... 379/45
6,591,094 B1 * 7/2003 Bentley ..... 455/405
6,661,340 B1 * 12/2003 Saylor et al. ..... 340/517
6,703,930 B1 * 3/2004 Skinner ..... 340/539.11
2001/0032236 A1 * 10/2001 Lin ..... 709/203
2002/0177428 A1 * 11/2002 Menard et al. ..... 455/404
2003/0141971 A1 * 7/2003 Heiken ..... 340/506

* cited by examiner

*Primary Examiner*—Daniel Wu
*Assistant Examiner*—Samuel J. Walk
(74) *Attorney, Agent, or Firm*—Cardinal Law Group

(57) ABSTRACT

A disaster recovery virtual roll call and recovery management system and method allows any organization to locate their staff and allocate resources to their staff in the event of a disaster. User information can be stored on remote, distributed computer networks to assure that the information is available during a disaster. The computer networks can be web networks and Interactive Voice Response (IVR) networks, to provide different methods of user interaction with the system. In case of disaster, the system can contact the users over one or more communications networks, such as by email or IVR message, and request the user provide their status. The users can send user status updates to the web network using internet enabled devices, such as personal computers, telephones, or handheld portable computers, or to the IVR network using standard or wireless telephones. The system can compile the information, and generate reports on group and individual status.

33 Claims, 25 Drawing Sheets

Send Emergency Broadcast Menu

Choose Email Message: Default Earthquake generic

Send to the following locations:

Choose Office: ☐ Hara Center AND ☐ Tokyo AND ☐ INHOUSE AND ☐ Hashima

◉ Everyone OR ○ Non respondents

☑ Employees AND ☐ DRS Admins AND ☐ Management

Method: ○ Email ○ IVR ○ Email+IVR

Phone Number Selection (If using IVR):
☐ Home Phone ☐ Mobile Phone ☐ Work Phone ☐ Other Phone 1 ☐ Other Phone 2

Phone Number Priority (if using IVR):
○ Home Phone ○ Mobile Phone ○ Work Phone ○ Other Phone 1 ○ Other Phone 2

Submit Reset

日本語表示に変更
Main Menu
Emergency Bulletins
General Company Info
Log Out

DRSJAPAN Home

© Contact Japan and ReloJapan 2002

Fig. 3F

Send Information Broadcast Message

Choose Email Message: Default Earthquake generic

Send to the following locations:

Choose Office: ☐ Hara Center AND ☐ Tokyo AND ☐ INHOUSE AND ☐ Hashima

◉ Everyone OR ○ Non respondents

☐ Employees AND ☐ DRS Admins AND ☐ Management

Method: ○ Email ○ IVR ○ Email+IVR

Phone Number Selection (If using IVR):
☐ Home Phone ☐ Mobile Phone ☐ Work Phone ☐ Other Phone 1 ☐ Other Phone 2

Phone Number Priority (if using IVR):
○ Home Phone ○ Mobile Phone ○ Work Phone ○ Other Phone 1 ○ Other Phone 2

Submit Reset

日本語表示に変更
Main Menu
Emergency Bulletins
General Company Info
Log Out

DRSJAPAN Home

© Contact Japan and ReloJapan 2002

Fig. 3G

List Of Employees

Add Employee
Click On An Employee Name To Edit
Last Name, First Name - 1) Status - 2) PIN - 3) Confirmation Answer - 4) Employee Number

---

, - 1) Administrator - 2)1111 - 3) 1234 - 4) 1
Binda, Gary - 1) Employee - 2)101871 - 3) 101871 - 4)
Brookes, Jay - 1) Employee - 2)200 - 3) 200 - 4)
Brown, James - 1) Employee - 2)7900 - 3) 7900 - 4)
Carrey, Jim - 1) Employee - 2)4444 - 3) Steve - 4)
Drummond, Fay - 1) Employee - 2)100 - 3) 100 - 4)
Green, Jim - 1) Employee - 2)7777 - 3) 7777 - 4)
Green, Alan - 1) Employee - 2)987654 - 3) 7777 - 4)
Hladilek, James - 1) Employee - 2)666 - 3) 666 - 4)
~~kasahara, masashi - 1) Administrator - 2)1927 - 3) 1111 - 4) 1927~~
kasahara2, masashi2 - 1) Administrator - 2)9927 - 3) 1111 - 4) 1927
Kawamura, Yoshiro - 1) Administrator - 2)1234 - 3) 1234 - 4)
Kay, Paul - 1) Employee - 2)7 - 3) 7 - 4)
Keller, Karen - 1) Employee - 2)1234567 - 3) 7777 - 4)
Keller, Shanna - 1) Employee - 2)123456 - 3) 7777 - 4)
Maia, Isamar - 1) Administrator - 2)1937 - 3) 9876 - 4)
Reid, Scott - 1) Administrator - 2)3333 - 3) 1810 - 4) 333
Rogers, Jim - 1) Employee - 2)12345 - 3) 7777 - 4)
Safar Alinia, Hiroko - 1) Administrator - 2)776 - 3) 1231 - 4) 0776
Smith, Joe - 1) Employee - 2)5555 - 3) boomer - 4)
Smith, Norman - 1) Employee - 2)9876567 - 3) 555 - 4)
Spade, Jean - 1) Administrator - 2)1420 - 3) 1420 - 4)
Stanher, Rick - 1) Employee - 2)99 - 3) 99 - 4)
Takada, Maho - 1) Employee - 2)2345678 - 3) 7777 - 4)
test, test - 1) Employee - 2)8888 - 3) 1234 - 4)
test, test - 1) Employee - 2)1408 - 3) 1234 - 4)
Unknown, Unknown - 1) Administrator - 2)0 - 3) 0 - 4) 0
ハラデレック, エリック - 1) Administrator - 2)2 - 3) 2222 - 4) 1408
安堵, 栄一 - 1) Employee - 2)98989898 - 3) 98989898 - 4)
千枝, 千枝 - 1) Administrator - 2)9999 - 3) 1111 - 4)

Add Employee

日本語表示に変更
Main Menu
Emergency Bulletins
General Company Info

Fig. 3I

Update Notify Profile

Enter Up To 20 People You Would Like Notified Every Time You Update Your Status

1) Last Name, First Name -- Email
2) Last Name, First Name -- Email
3) Last Name, First Name -- Email
4) Last Name, First Name -- Email
5) Last Name, First Name -- Email
6) Last Name, First Name -- Email
7) Last Name, First Name -- Email
8) Last Name, First Name -- Email
9) Last Name, First Name -- Email
10) Last Name, First Name -- Email
11) Last Name, First Name -- Email
12) Last Name, First Name -- Email
13) Last Name, First Name -- Email
14) Last Name, First Name -- Email
15) Last Name, First Name -- Email
16) Last Name, First Name -- Email
17) Last Name, First Name -- Email
18) Last Name, First Name -- Email
19) Last Name, First Name -- Email
20) Last Name, First Name -- Email Click On Last name to edit 日本語表示に変更
Main Menu
Emergency Bulletins
General Company Info
Log Out DRSJAPAN Home © Contact Japan and ReloJapan 2002

Fig. 4C

Dear Mr. Roche (Administrator):
**Dean Cadre *(employee)*** sent a Status Report. The contents are:

Status: "I am OK." Current Location: "Home" Comment: "No Comment"

Details:

| | |
|---|---|
| Full Employee Name: | Dean "Deano" George Cadre. |
| Control office: | Tokyo |
| Employee ID: | 141100012 |
| Message Received: | October 10, 2001 |
| Employee Contact Info: | |
| Home Phone: | 03-1234-5678 |
| Mobile: | 090-1234-5678 |
| Other Phone: | 03-4564-6578 |
| Email1: | deano@iLoveCanada.com |
| Email2: | dean@hotmail.com |

Fig. 6

DISASTER RECOVERY VIRTUAL ROLL CALL AND RECOVERY MANAGEMENT SYSTEM

CROSS-REFERENCE TO RELATED APPLICATIONS

This application claims priority to Japanese Patent Application No. 2002-120886 filed on Apr. 23, 2002, and hereby incorporated by reference in its entirety.

TECHNICAL FIELD

The technical field of the present invention is communications, particularly, a disaster recovery virtual roll call and recovery management system.

BACKGROUND OF THE INVENTION

Disasters, such as earthquakes, floods, fires, or terrorist events pose a threat to company personnel. With global business, company personnel may be located anywhere in the world. When disaster strikes, the company must determine which employees require assistance and where to focus the assistance. If company records are in a central location, the disaster may destroy the records, preventing the company from knowing where its employees are. In addition, the disaster may disable the communications systems that would allow the employees to check in and notify the company of their status. The company needs to establish the status of their employees, but also needs to provide user status information to concerned third parties, such as families and loved ones. The company also needs a way to provide instructions and general information to the employees.

U.S. Pat. No. 6,262,666 to Lodichand, dated Jul. 17, 2001, Method Of And Apparatus For Individuals To Maintain A Trail Of Their Well Being And Whereabouts discloses a system in which location and/or well-being information is periodically entered by the individual and is transmitted to one or more central sites. When further location and/or well-being information is not received within a predetermined interval after the most recently reported location and/or well-being information is received, an automated voice response system attempts to contact the individual. If the automated contact fails to connect with the individual, a customer service representative pursues the attempt. After both failed attempts, an emergency message is then supplied to a prearranged emergency contact and the recorded location and/or well-being information, which has been kept strictly confidential up to this point, is released to the emergency contact.

U.S. Pat. No. 6,028,514 to Lemelson, deceased, et al., dated Feb. 22, 2000, Personal Emergency, Safety Warning System And Method discloses a comprehensive system and method for monitoring a geographic person location, periodically warning a person of emergency situations in the geographic location, and transmitting requests for assistance in emergency situations. The system comprises a warning unit that is carried by the person or that is located in mobile units or in buildings or houses. The system further comprises a command center, which includes a database computer having a database storage unit, a transmitter for broadcasting signals to the warning unit, a receiver for receiving signals, a transmitter for transmitting signals to emergency response units and centers, and other such communication devices.

U.S. Pat. No. 5,742,233 to Hoffman, et al., dated Apr. 21, 1998, Personal Security And Tracking System discloses a signaling system comprising a portable signaling unit, a remote alarm switch device, a central dispatch station, and a wireless communication system such as a cellular or telephone system, etc., and a GPS or alike system. When the person in distress activates the remote alarm switch or when the remote alarm switch is removed from the individual by a forceful or unauthorized action or when the signaling unit is removed from the proximity of the remote alarm switch, the portable signaling unit sends a data transmission which includes its location to the central dispatch station. The portable signaling unit can be remotely activated from a central dispatch station to determine and monitor the location of the portable signaling unit. The signaling system also allows the central dispatch operator to selectively establish two-way voice contact with the person carrying the portable signaling unit.

It would be desirable to have a disaster recovery virtual roll call and recovery management system that would overcome the above disadvantages.

SUMMARY OF THE INVENTION

One aspect of the present invention provides a disaster recovery virtual roll call and recovery management system that allows determining which personnel require assistance.

Another aspect of the present invention provides a disaster recovery virtual roll call and recovery management system that allows personnel to report their status over diverse communication channels.

Another aspect of the present invention provides a disaster recovery virtual roll call and recovery management system that maintains personnel data at distributed locations.

Another aspect of the present invention provides a disaster recovery virtual roll call and recovery management system that provides multiple alternative communication channels.

Another aspect of the present invention provides a disaster recovery virtual roll call and recovery management system that provides status reports to outside parties.

The foregoing and other features and advantages of the invention will become further apparent from the following detailed description of the presently preferred embodiments, read in conjunction with the accompanying drawings. The detailed description and drawings are merely illustrative of the invention, rather than limiting the scope of the invention being defined by the appended claims and equivalents thereof.

BRIEF DESCRIPTION OF THE DRAWINGS

FIGS. 4A–4E show examples of computer screens for a user interface for a disaster recovery virtual roll call and recovery management system made in accordance with the present invention.

FIG. 6 shows an example of a transactional report for a disaster recovery virtual roll call and recovery management system made in accordance with the present invention.

DETAILED DESCRIPTION OF THE PRESENTLY PREFERRED EMBODIMENT

A disaster recovery virtual roll call and recovery management system and method of the present invention allows an organization to locate their staff and allocate resources to their staff in the event of a disaster. User information can be stored on remote, distributed computer networks to assure that the information is available during a disaster. The computer networks can be web networks and Interactive Voice Response (IVR) networks, to provide different methods of user interaction with the system. In case of disaster, the system can contact the users over one or more communications networks, such as by email or IVR telephone message, and request the user provide their status. The users can send user status updates to the web network using internet enabled devices, such as personal computers, telephones, or handheld portable computers, or to the IVR network using standard or wireless telephones. The system can compile the information, and generate reports on group and individual status. In addition, the system can send information messages with vital disaster information and can request further user status updates as events unfold.

Figure 1:
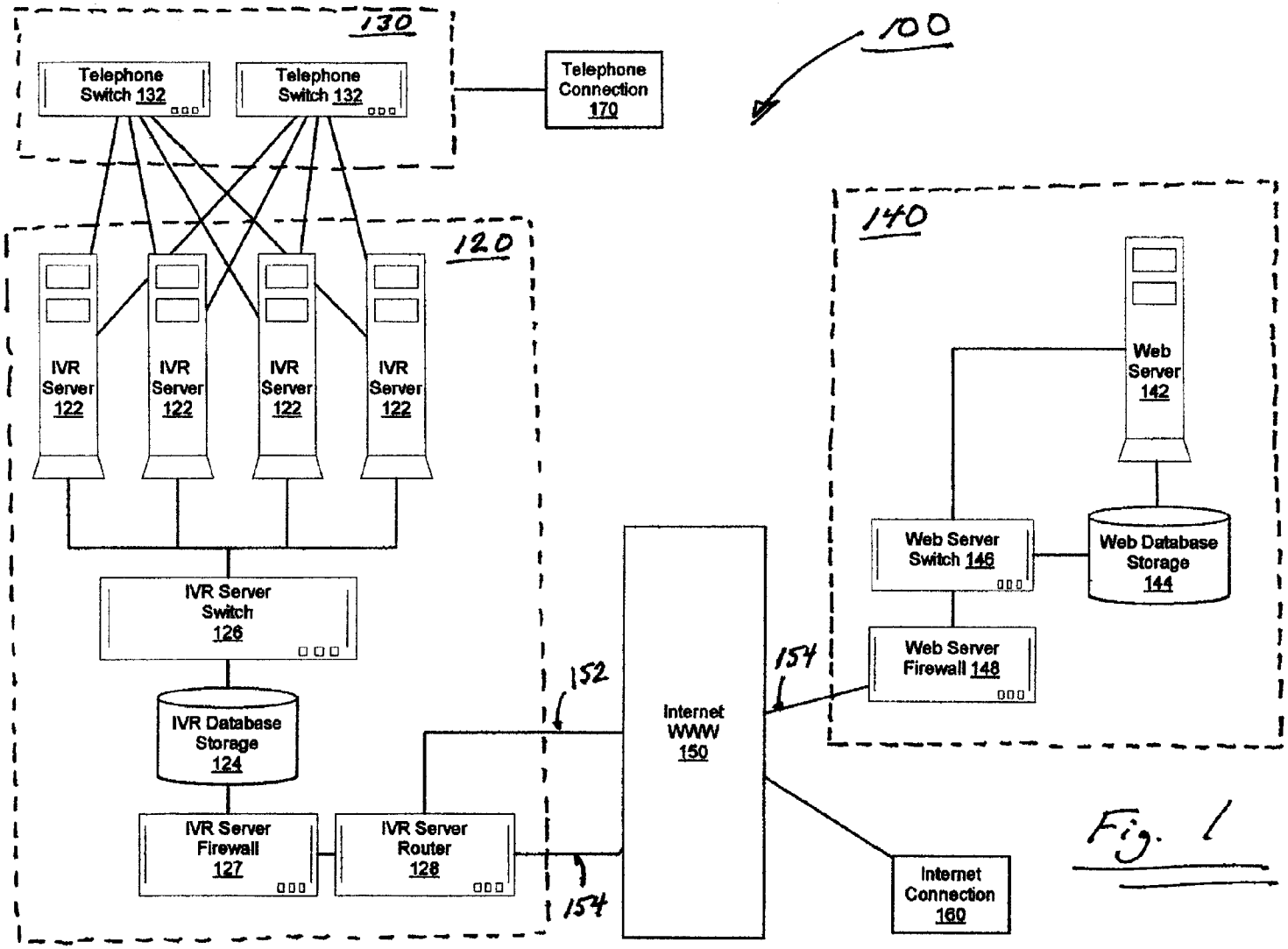
FIG. 1 shows a block diagram of a network for a disaster recovery virtual roll call and recovery management system made in accordance with the present invention.

FIG. 1 shows a block diagram of a disaster recovery system network for a disaster recovery virtual roll call and recovery management system made in accordance with the present invention. A disaster recovery system (DRS) network 100 comprises an Interactive Voice Response (IVR) network 120, a telephone network 130, a web network 140, an internet connection 160, and a telephone connection 170.

The Interactive Voice Response (IVR) network 120 can be one or more computer networks that manage the IVR functions of the DRS network 100, including receipt, storage, and transmission of user information and DRS messages, and report generation. The Interactive Voice Response (IVR) network 120 comprises one or more IVR servers 122 connected to an IVR database storage 124. The IVR network 120 can include an IVR server switch 126 if more than one IVR server 122 is used, an IVR server firewall 127 to provide security for the IVR servers 122, and an IVR server router 128 if more than one internet connection is used. The IVR server 122 can be a conventional automatic call distribution (ACD) server as is well known to those skilled in the art, running an operating system such as Windows NT or UNIX, or the like. The IVR database storage 124 can be conventional storage, such as magnetic or optical storage. The IVR database storage 124 can use a structured query language (SQL) relational database structure, such as Microsoft SQL 7.0, in querying, updating, and managing database, although other structures such as Oracle could also be used. In one embodiment, the IVR application can be written in Visual Basic and run on an automatic call distribution (ACD) system.

The IVR network 120 is operably connected to a telephone network 130, which comprises one or more telephone switches 132. If multiple telephone switches 132 or multiple IVR servers 122 are used, multiple connections can be provided between the telephone switches 132 and the multiple IVR servers 122 to improve call capacity and provide redundant communication paths. The telephone switches 132 can be conventional telephone switches used by telephone companies, as will be appreciated by those skilled in the art.

The web network 140 can be one or more computer networks that manage the web functions of the DRS network 100, including receipt, storage, and transmission of user information and DRS messages, and report generation. The web network 140 comprises one or more web servers 142 connected to web database storage 144. The web network 140 can include a web server switch 146 if more than one web server 142 is used, and a web server firewall 148 to provide security for the web server 142. The web server 142 can be a conventional server as is well known to those skilled in the art, such as IIS or Apache running an operating system such as Windows NT or UNIX, or the like. The web database storage 144 can be conventional storage, such as magnetic or optical storage. The web database storage 144 can use a structured query language (SQL) relational database structure, such as Microsoft SQL 7.0, in querying, updating, and managing the database, although other structures such as Oracle could also be used. In one embodiment, the web application can be written in ColdFusion. In other embodiments, the web application can be written in other Common Gateway Interface (CGI) languages.

The IVR network 120 can be operably connected to the web network 140 across the World Wide web on the internet 150. Depending on the information volume expected and the redundancy required, the IVR network 120 and web network 140 can be connected to the internet 150 through conventional wire 152 and fiber optics 154, and multiple connections can be provided. The data in the IVR database storage 124 and the web database storage 144 can be synchronized over the internet 150.

Users can access the DRS network 100 through a communication network, such as internet connection 160 or telephone connection 170. Multiple access modes assure that the users will be able to connect to the DRS in the event of a disaster, even if some of the access modes have been disabled by the disaster. Because of the ubiquitous nature of the internet, the internet connection 160 can be made at any number of physical locations. The internet connection 160 can be any device capable of connecting to the internet, such as an internet enabled home or office personal computer with a web browser, connected as wired or wireless; or an internet enabled wireless device utilizing protocols, such as CHTML, HDML or WAP, for example; or a handheld or notebook portable computer with a wireless internet connection. The devices can also include those under development, such as two ways pagers, internet enabled watches, internet enabled clothing, internet enabled household appliances, and the like. The internet enabled devices, particularly the mobile internet devices, can include Global Positioning System (GPS) circuits to pinpoint the location of the device and can supply the location information to the DRS to aid in locating users. The telephone connection 170 can be any standard or wireless telephone capable of voice transmission.

The various components of the DRS network 100 can be distributed geographically to provide assurance that the DRS remains functional and data remains available in case of a disaster. For example, if a company has a concentration of employees in a city such as Tokyo, Japan, the telephone network 130 could be located in Tokyo, the IVR network 120 could be located in another part of Japan, such as Nagoya, and the web network 140 could be located on another continent, such as in the United States. Those skilled in the art will appreciate that many equipment distributions are possible, depending on the degree of reliability required.

Figure 2A:
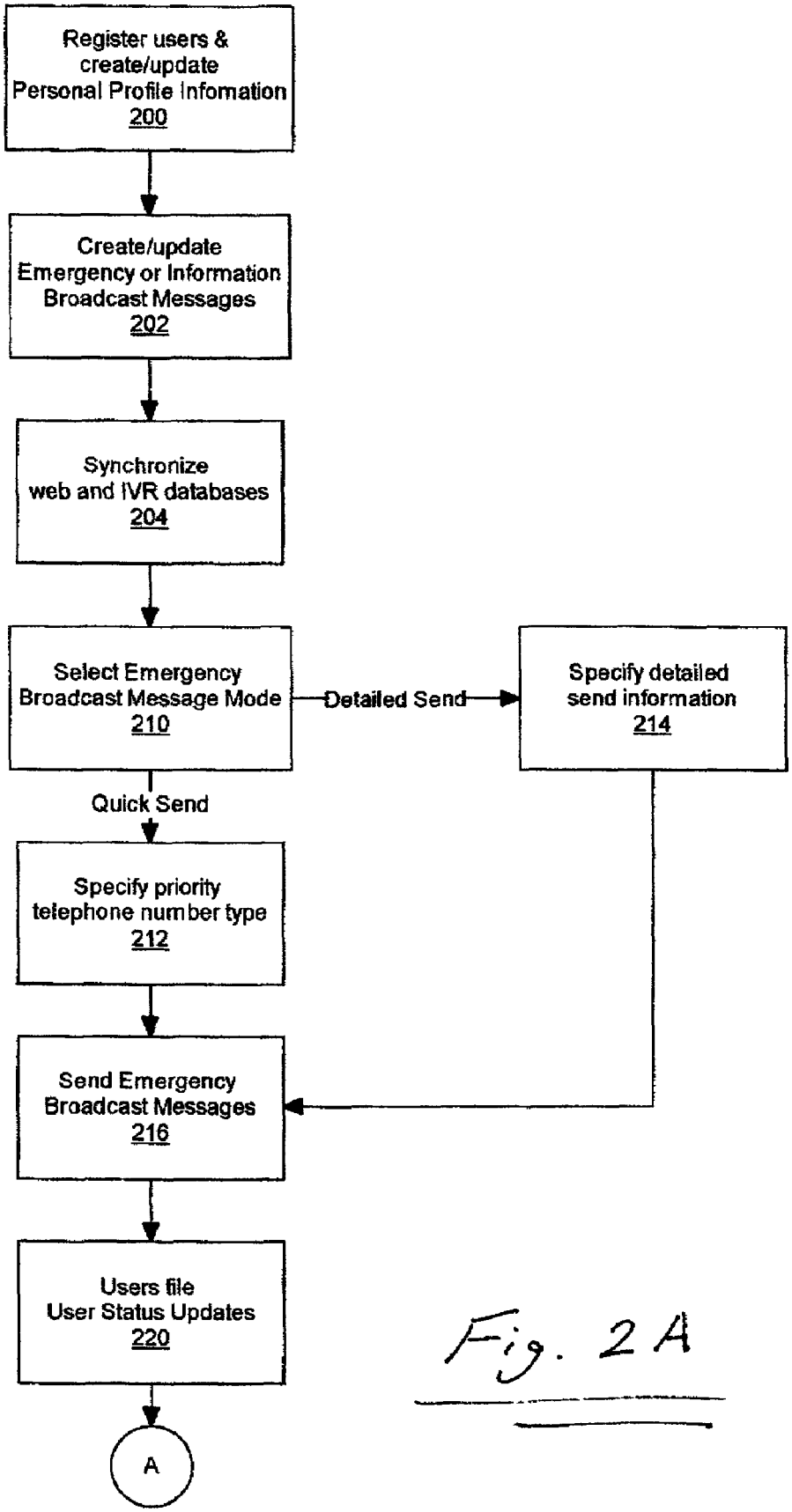
FIGS. 2A–2B show a flow chart for preparation and use of a disaster recovery virtual roll call and recovery management system made in accordance with the present invention.
Figure 2B:
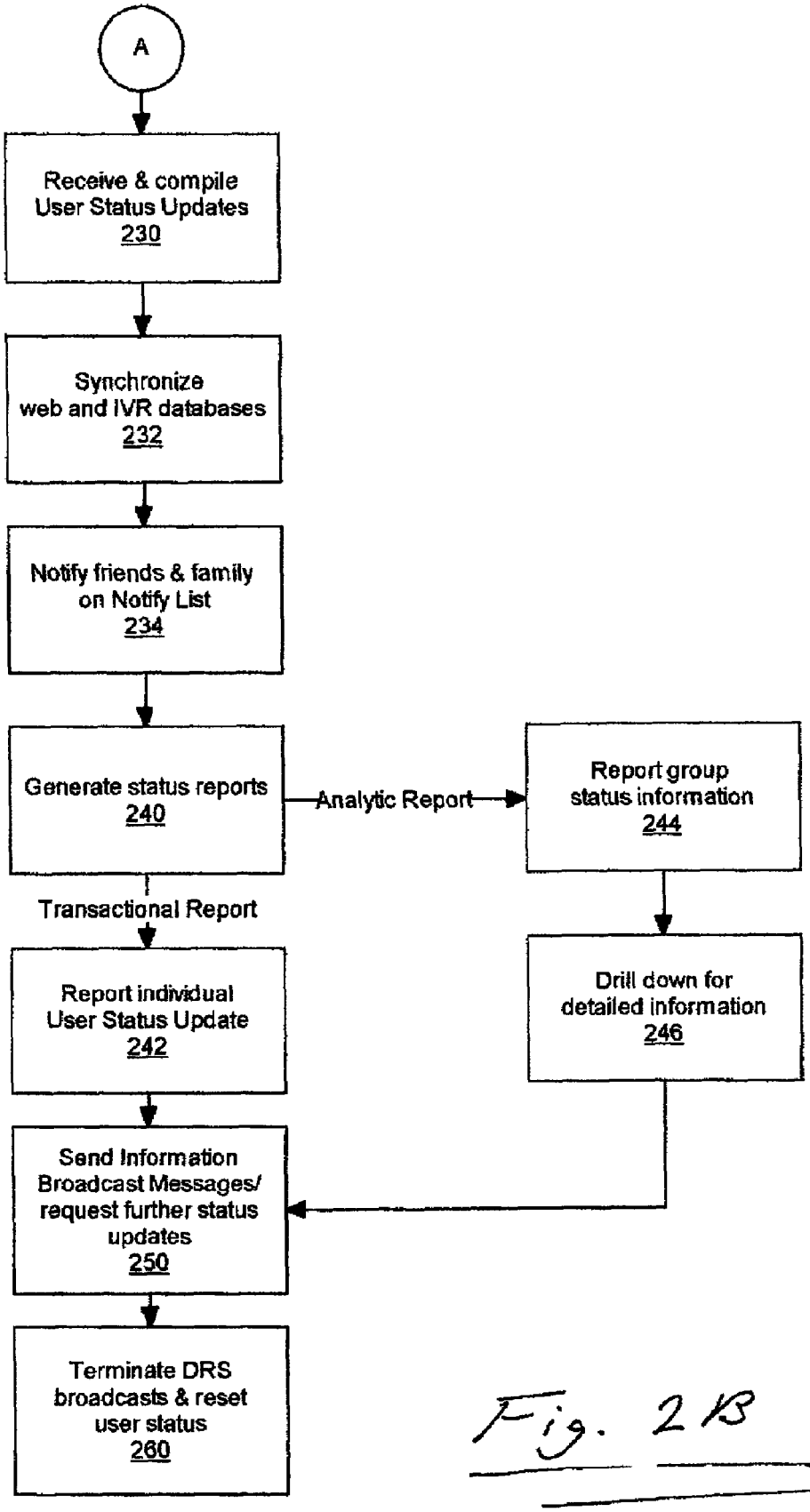

FIG. 2 shows a flow chart for preparation and use of a disaster recovery virtual roll call and recovery management system made in accordance with the present invention. The method comprises preparing the Disaster Recovery System (DRS) for broadcasting, sending Emergency Broadcast Messages, receiving and compiling User Status Updates, generating status reports, and terminating the DRS. The DRS can also Information Broadcast messages to provide further information and request further User Status Updates. Users can interact with the DRS through the Interactive Voice Response (IVR) system, the internet, or a combination of the two.

Users of the Disaster Recovery System (DRS) can be classified as a user type of administrator, management, or employee for matters of system and information access. Administrators can control the DRS and have full access to the DRS program functions. Management can include executive management in a decision-making capacity that may need to receive confidential information during an emergency. Employees can access portions of the DRS to register and update their own information, and report their own status in a disaster. Users can be assigned a unique PIN number to allow access to the DRS, while excluding non-users.

Referring to FIG. 2, preparing the Disaster Recovery System (DRS) comprises creating and updating user registrations 200 and creating and updating broadcast messages 202.

User registration is completed before the disaster and can be performed on an internet enabled computer. In one embodiment, an administrator can input the user's name, office location, user type, and one email address, and the DRS will forward a registration confirmation notice by email to the new user explaining the DRS and its use, and requesting the user to input their Personal Profile Information of general and contact information and their third party notification information in a Notify List of email addresses of third parties, such as friends or families, to whom the user would like an email sent when the user updates their status in the event of a disaster. After the user has entered the Personal Profile Information, the user can reset their PIN number to any PIN number desired. An administrator can have access to modify the user's Personal Profile Information, including office location and user type.

The administrator can configure the DRS to automatically send an email message to all users at a predetermined interval, such as 90 days, to remind them to update their Personal Profile Information if their contact information has changed. In an alternate embodiment, the administrator or other personnel can enter the Personal Profile Information, rather than having the user enter the Personal Profile Information. The Personal Profile Information is stored in the web database storage, which is synchronized with the IVR database storage at 204 of FIG. 2 to provide redundancy.

An Emergency Broadcast Message can be recorded in the DRS before the disaster so that an administrator can send the message quickly when a disaster strikes. The Emergency Broadcast Message can typically indicate that the DRS has been activated and request that users report their status. In one embodiment, an administrator can record more than one Emergency Broadcast Message and select a particular Emergency Broadcast Message when activating the DRS. In another embodiment, an administrator is limited to recording a single Emergency Broadcast Message for each of the IVR network or web network to avoid confusion during activation. The administrator can also record an Information Broadcast Message, which is similar to the Emergency Broadcast Message, but contains less time sensitive or less important information, so that lower priority delivery is possible.

Because the Emergency and Information Broadcast Messages can be delivered from the IVR network or web network, separate voice and text Broadcast Messages can be provided for each network. An administrator can record the voice IVR Broadcast Message through the telephone connection to the IVR network using a standard or wireless telephone capable of voice transmission. An administrator can record the text web Broadcast Message through the internet connection using any internet capable device. The IVR Broadcast Message for the IVR network is stored in the IVR database storage and the web Broadcast Message for the web network is stored in the web database storage. The IVR database storage and the web database storage are synchronized at 204 of FIG. 2 to provide redundancy.

Referring to FIG. 2, when a disaster occurs, the administrator prepares the DRS for broadcasting by selecting an Emergency Broadcast Message mode 210. If the DRS is dormant, i.e., has not been activated, a user calling the IVR network will receive a message that the DRS system has not been activated and a user connecting to the web network will see a message that the system has not been activated. Users can update their Personal Profile Information while the system is dormant. The DRS can have a Send Status Updates Option set by an administrator so that the administrator receives an email whenever a user changes their personal information. The Send Status Updates Option can be shut off following activation in a disaster to avoid the distraction of numerous emails to an administrator as users report their status. The administrator can prepare the DRS using the web network or the IVR network.

If an administrator uses the web network to prepare the DRS, the administrator first logs into the DRS on an internet enabled device such as a PC, by entering a personal PIN and providing an answer to a preset personal question. DRS recognizes the user as an administrator and provides full access to an administrator menu. The administrator can check when the last message was sent on DRS to ensure that another administrator has not already activated the DRS. The administrator then has the option of sending the Emergency Broadcast Message as a Quick Send or a Detailed Send.

For a Quick Send mode, the administrator chooses the users' priority telephone number type to be called first and clicks send 212. The priority telephone number type typically corresponds to the telephone where the users are most likely to be reached at the time of DRS activation, i.e., on the user's mobile, home, or office telephone. If a particular user does not have a telephone number for the selected priority telephone number type, the next available telephone number for the particular user will be automatically selected by the Auto dialer to be called first. A confirmation message asking the administrator to confirm the intention to send the Emergency Broadcast Message appears on the screen and the administrator can check again when the last message was sent on DRS to ensure that another administrator has not already activated the DRS. If the administrator confirms and again clicks send, the DRS is activated and sending of the Emergency Broadcast Message begins.

Typical default actions for a Quick Send can be that the Emergency Broadcast Message will be the prerecorded default message previously set by the administrator; the Emergency Broadcast Message will be sent to all user types across all office locations; the Emergency Broadcast Message will be sent by telephone and email to all telephone numbers and email addresses recorded in the users' personal profiles; the emailed Emergency Broadcast Message will contain hypertext links to the Emergency Information Bulletin Board and General Company Information Areas; the Send Status Updates Option will be shut off to avoid the distraction of numerous emails to an administrator as users report their status; and Notify List Status Updates Option will be turned on to send a status update to each person on the user's Notify List when a status update is made.

For a Detailed Send mode, the administrator has a number of options they can select 214. The administrator can review the current Emergency Broadcast Message and record a new message, if desired; choose the users' priority telephone number type to be called first; choose all or selected geographical locations to receive the Emergency Broadcast Message; choose email, IVR, or both to deliver the Emergency Broadcast Message; and choose user types to receive the Emergency Broadcast Message. If the message is a follow-up message after the initial DRS activation, the administrator can choose to send the Emergency Broadcast Message to all users or only to those who have not responded to earlier messages (non-respondents). Once the options have been selected, the administrator clicks send and a confirmation message asks the administrator to confirm the intention to send the Emergency Broadcast Message. If the administrator confirms and again clicks send, the DRS is activated and sending of the Emergency Broadcast Message begins.

The IVR network uses scripted messages to provide selection options. For an administrator to use the IVR network to prepare the DRS, the administrator first connects with the DRS on a telephone. The IVR network says, "Press 1 for English, 2 for Japanese," and the administrator selects a language option. The IVR network plays an initial greeting: "DRS system has not been activated you are not asked at this time to update your status" if DRS has not been activated or "System has been activated, please update your status" if DRS has been activated earlier and this is not the initial activation.

The IVR network says, "Please enter your PIN and press the # key." If the administrator enters an invalid PIN, the IVR network says, "You have entered an invalid PIN. Press 1 to re-enter your PIN, Press 2 to leave a general voice message." If the administrator enters a valid PIN, the IVR network asks a pre-selected confirmation question, such as "What are the last four digits of your home phone number?" If the administrator responds incorrectly, the IVR network says, "Your answer is not correct, Press 1 to re-try your answer, Press 2 to leave a general voice message." If the administrator responds correctly, the IVR network identifies the caller as an administrator and says, "Press 1 to update your status, Press 2 to enter the Administrator Menu." To set up an Emergency Broadcast Message and prepare the DRS, the administrator selects the Administrator Menu.

The administrator has the option of sending the Emergency Broadcast Message as a Quick Emergency Broadcast Send or a Normal Emergency Broadcast Send. The Admin Menu of the UVR network offers the following options: Press 1 for the Quick Emergency Broadcast menu; Press 2 for the reception message menu; Press 3 for the for the emergency broadcast message menu; Press 4 for the report menu; Press 5 for the information broadcast message menu; and Press 6 to stop your current broadcast message.

For the Quick Emergency Broadcast Send 212, the administrator selects 1 and the IVR network offers options for the priority phone numbers to which the Emergency Broadcast Message is to be sent: press 1 for mobile phone; press 2 for home phone; and press 3 for office phone. The priority telephone number type typically corresponds to the telephone where the users are most likely to be reached at the time of DRS activation, i.e., on the user's mobile, home, or office telephone. The IVR network repeats the priority phone number option selected by the administrator and allows the priority phone number option to be re-selected if it is not the option the administrator wanted. If the priority phone number option is the option the administrator wanted, the IVR network directs the administrator: press 1 if this is correct and you would like to start the emergency broadcast. The administrator presses 1, then the IVR network acknowledges "Broadcasting has started" and offers the option to "Press * to return to the admin menu."

For a Normal Emergency Broadcast Send 214, the administrator selects 3 from the Admin Menu. The Normal Send Menu of the IVR network then offers the following options: Press 1 to play the Emergency broadcast message; Press 2 to record a new Emergency broadcast message; and Press 3 to enter Emergency broadcast message recipient menu.

If 2 is selected to record a new Emergency Broadcast message, the administrator can Press 1 to start recording, Press # when finished, and receive a confirmation message that "Your message has been recorded."

If 3 is selected to enter the Emergency broadcast message recipient menu, the IVR network directs the administrator that the locations to be sent the Emergency Broadcast message can be selected individually or in combination, and to press # when finished, directing "Press 1 for location 1; Press 2 for location 2; Press 3 for location 3." Specific geographic or work locations can be inserted as location 1, location 2, and location 3 in the recorded message. After the locations are selected, the IVR network offers the options of "Press 1 for all users" and "Press 2 for non-respondents." This allows the administrator to send the initial Emergency broadcast message to everyone and send follow-up messages only to those users who have not responded. After the selected, the IVR network offers the options of sending the Emergency Broadcast message by email, IVR, or both email and IVR: "Press 1 for email only," "Press 2 for IVR only," and "Press 3 for email and IVR." The IVR network directs the administrator that the user types to be sent the Emergency Broadcast message can be selected individually or in combination, and to press # when finished, directing "Press 1 for Employees; Press 2 for DRS Administrators; Press 3 for Management." The IVR network then offers options for the priority phone numbers to which the Emergency Broadcast Message is to be sent: press 1 for mobile phone; press 2 for home phone; and press 3 for office phone. The priority telephone number type typically corresponds to the telephone where the users are most likely to be reached at the time of DRS activation, i.e., on the user's mobile, home, or office telephone. The IVR network repeats the priority phone number option selected by the administrator and allows the priority phone number option to be re-selected if it is not the option the administrator wanted. If the priority phone number option is the option the administrator wanted, the IVR network directs "If this is correct press 1 to start broadcasting, if you would like to change your selections, press 2," to return to the beginning of the Normal Emergency Broadcast Send menu. If the administrator presses 1, the IVR network acknowledges "Broadcasting has started" and offers the option to "Press 9 to return to the admin menu."

At 216 of FIG. 2, the Emergency Broadcast Messages can be sent to selected users by email and/or IVR, and a User Status Update requested. The user can file the User Status Update 220 using the web network or the IVR network. The User Status Update containing user status information can include information from the user indicating the user's status as OK or Not OK; the user's current location (home, office or other); and status comments including additional information entered by the user to help describe his/her situation. The users can be provided with wallet-sized cards listing the log-in site for the web network and/or the phone number for the IVR network, plus access instructions, to make it easier for the users to recall the access procedure during a disaster.

If a user receives the Emergency Broadcast Message by email, the Emergency Broadcast Message can contain a hypertext link to the DRS, so the user can click on the link in the email message to access the DRS login page. The user can also log into the DRS login page by typing the web page address into a web browser if the user received the Emergency Broadcast Message by telephone. If a user uses the web network to file their User Status Update, the user first logs into the DRS on an internet enabled device, such as a PC or internet enabled wireless device, by entering a personal PIN and providing an answer to a preset personal question. The user can then provide their status as OK or Not OK; their current location (home, office or other); and their status comments including additional information entered by the user to help describe his/her situation. The user can then submit their User Status Update.

In one embodiment, the users can be encouraged to use the web network to file their User Status Update, rather than the IVR network. Using the web network can have the advantages of avoiding use of limited phone line bandwidth; using the more reliable system when telephone lines may be down from the disaster; providing access to links to the company Emergency Information Bulletin Board, which can be updated by the company at any time to provide instructions or information on status of the company; and allowing users to automatically notify family/friends of their status via email if their email addresses have been pre-registered in the users' Notify List.

For a user to use the IVR network to file the User Status Update, the user first connects with the DRS on a telephone. The IVR network uses scripted messages to provide selection options. The IVR network says, "Press 1 for English, 2 for Japanese," and the user selects a language option. The IVR network plays an initial greeting indicating the DRS has been activated: "System has been activated, please update your status."

The IVR network says, "Please enter your PIN and press the # key." If the user enters an invalid PIN, the IVR network says, "You have entered an invalid PIN. Press 1 to re-enter your PIN, Press 2 to leave a general voice message." If the user enters a valid PIN, the IVR network asks a pre-selected confirmation question, such as "What are the last four digits of your home phone number?" If the user responds incorrectly, the IVR network says, "Your answer is not correct, Press 1 to re-try your answer, Press 2 to leave a general voice message." If the user responds correctly, the IVR network says, "Please enter 1 if you are OK, 2 if you are not OK". The IVR network then requests confirmation of the status selection: "You have entered you are ####, press 1 if this is correct, otherwise press 2 to re-enter." The IVR network then requests the user's location: "Please enter your location. Press 1 for office, 2 for home, 3 for other," and requests confirmation of the location: "You have entered ####, press 1 if correct, 2 to re-enter." The user then has the option to leave a voice message: "Press 1 to leave a voice message, press # to quit." If the user decides to leave a message, the IVR network provides the instructions: "Press 1 to start recording, press # when finished," and confirms the recording: "Your message has been recorded." When the user presses # to quit, with or without leaving a message, the IVR network exits: "Thank you for using DRS. Goodbye."

At 230 in FIG. 2, the DRS then receives and compiles User Status Updates. The DRS stores the User Status Updates made on the web network in the web database storage and the User Status Updates made on the IVR network in the IVR database storage. The data in the web database storage and the IVR database storage can be synchronized over the internet at 232, so that the up-to-date information is available from both the web network and the IVR network. The web database storage and the IVR database storage can be synchronized from about every 5 to 30 minutes, and is typically synchronized about every 15 minutes. The information can be used to provide reports of user status.

If the user has provided third party notification information in a Notify List in their personal profile of email addresses of friends or families to whom the user would like an email sent when the user updates their status in the event of a disaster, the DRS will forward the User Status Updates to those on the Notify List at 234. The Notify List Status Updates Option can be turned off by the administrator if the computer infrastructure is limited due to the disaster.

At 240 in FIG. 2, the DRS provides options for generating status reports. The DRS provides two types of reports: transactional and analytical. The transactional report 242 is an email sent to the administrator whenever a user logs their status, e.g. "Mr. Smith has indicated he is OK." The administrator can turn off the Send Status Updates Option to avoid the distraction of numerous emails as all the users report their status. Analytical reports summarize the status of all users, e.g. "100 users reported in OK, 10 not OK, and 13 did not report in," along with statistics on the current location.

FIG. 6 shows an example of a transactional report. The transactional report can include Status, Current Location, Comments, and Personal Profile Information, as well as other information that may be useful in a disaster.

Analytical reports provide the administrator a general status report 244 and links allowing the administrator to drill down on details in detailed status reports on information in different categories 246. The analytical report can be produced in a text format using any internet enabled device, such as a PC or internet enabled wireless device. The general status report can be provided in an audio format over the IVR network. In another embodiment, the IVR network can provide additional options to allow the administrator to drill down on details.

The general status report indicates the number of users registered in the DRS, the number reporting status as OK, the number reporting status as Not OK, and the number not reporting. By selecting the number in a category, the DRS can provide a list of users in that category. For example, clicking on the number reporting a status of Not OK can provide a list of the names of the users reporting a status of Not OK. Clicking on the name of any of the users in the list can provide the user's Personal Profile Information, including any comments entered as text through an internet enabled device or recorded as a voice message through the IVR network.

Referring to FIG. 2 at 250, the DRS provides the option of sending Information Broadcast Messages to provide users with further information and request further User Status Updates.

If an administrator uses the web network to send Information Broadcast Messages, the administrator first logs into the DRS on an internet enabled device such as a PC, by entering a personal PIN and providing an answer to a preset personal question. DRS recognizes the user as an administrator and provides full access to the administrator menu.

The administrator has a number of Information Broadcast Message options they can select. The administrator can review the current Information Broadcast Message and record a new message, if desired; choose the users' priority telephone number type to be called first; choose all or selected geographical locations to receive the Information Broadcast Message; choose email, IVR, or both to deliver the Information Broadcast Message; and choose user types to receive the Information Broadcast Message. The administrator can choose to send the Information Broadcast Message to all users or only to those who have not responded to earlier messages (non-respondents). Once the options have been selected, the administrator clicks send and a confirmation message asks the administrator to confirm the intention to send the Information Broadcast Message. If the administrator confirms and again clicks send, the DRS is activated and sending of the Information Broadcast Message begins.

The IVR network uses scripted messages to provide selection options. For an administrator to use the IVR network to prepare the DRS, the administrator first connects with the DRS on a telephone. The IVR network says, "Press 1 for English, 2 for Japanese," and the administrator selects a language option. The IVR network plays an initial greeting: "System has been activated, please update your status" as the DRS has been activated and this is not the initial activation.

The IVR network says, "Please enter your PIN and press the # key." If the administrator enters an invalid PIN, the IVR network says, "You have entered an invalid PIN. Press 1 to re-enter your PIN, Press 2 to leave a general voice message." If the administrator enters a valid PIN, the IVR network asks a pre-selected confirmation question, such as "What are the last four digits of your home phone number?" If the administrator responds incorrectly, the IVR network says, "Your answer is not correct, Press 1 to re-try your answer, Press 2 to leave a general voice message." If the administrator responds correctly, the IVR network identifies the caller as an administrator and says, "Press 1 to update your status, Press 2 to enter the Administrator Menu." To set up an Information Broadcast Message, the administrator selects the Administrator Menu.

The Admin Menu of the IVR network offers the following options: Press 1 for the Quick Emergency Broadcast menu; Press 2 for the reception message menu; Press 3 for the Emergency Broadcast Message menu; Press 4 for the report menu; Press 5 for the Information Broadcast Message menu; and Press 6 to stop your current broadcast message.

For a Information Broadcast Message Send, the administrator selects 5 from the Admin Menu. The Information Broadcast Message Menu of the IVR network then offers the following options: Press 1 to play the Information Broadcast Message; Press 2 to record a new Information Broadcast Message; and Press 3 to enter Information Broadcast Message recipient menu.

If 2 is selected to record a new Information Broadcast Message, the administrator can Press 1 to start recording, Press # when finished, and receive a confirmation message that "Your message has been recorded."

If 3 is selected to enter the Information Broadcast Message recipient menu, the IVR network directs the administrator that the locations to be sent the Information Broadcast Message can be selected individually or in combination, and to press # when finished, directing "Press 1 for location 1; Press 2 for location 2; Press 3 for location 3." Specific geographic or work locations can be inserted as location 1, location 2, and location 3 in the recorded message. After the locations are selected, the IVR network offers the options of "Press 1 for all users" and "Press 2 for non-respondents." This allows the administrator to send the Information Broadcast Message to everyone or only to those users who have not responded. After the recipients are selected, the IVR network offers the options of sending the Information Broadcast Message by email, IVR, or both email and IVR: "Press 1 for email only," "Press 2 for IVR only," and "Press 3 for email and IVR." The IVR network directs the administrator that the user types to be sent the Information Broadcast Message can be selected individually or in combination, and to press # when finished, directing "Press 1 for Employees; Press 2 for DRS Administrators; Press 3 for Management." The IVR network then offers options for the priority phone numbers to which the Information Broadcast Message is to be sent: press 1 for mobile phone; press 2 for home phone; and press 3 for office phone. The priority telephone number type typically corresponds to the telephone where the users are most likely to be reached at the time, i.e., on the user's mobile, home, or office telephone. The IVR network repeats the priority phone number option selected by the administrator and allows the priority phone number option to be re-selected if it is not the option the administrator wanted. If the priority phone number option is the option the administrator wanted, the IVR network directs "If this is correct press 1 to start broadcasting, if you would like to change your selections, press 2," to return to the beginning of the Information Broadcast Message Send menu. If the administrator presses 1, the IVR network acknowledges "Broadcasting has started" and offers the option to "Press 9 to return to the admin menu."

Referring to FIG. 2 at 260, the DRS provides the option of terminating the DRS. Once the disaster situation has stabilized and the users have been accounted for, the administrator can terminate the broadcast messages and reset the status of all users from the web network or the IVR network.

For the web network, the administrator enters the Message Center menu using any internet enabled device, such as a PC or internet enabled wireless device. The administrator can then click on the Cancel Broadcast Message button and Status All Clear message to terminate the broadcast messages and reset the status of all users.

For the IVR network, the administrator enters the Administrator Menu and selects the option: "Press 6 to stop your current broadcast message." The IVR network then offers the following options: Press 1 to stop your emergency broadcast; Press 2 to stop your information broadcast; Press 9 to return to the Administrator menu; and Press * to return to the Main menu. The administrator can stop the Emergency Broadcast Message and/or Information Broadcast Message, as desired, and return to another menu. To reset the status of all users, the administrator can select the report menu option from the Admin Menu and select the clear status option.

The DRS provides additional options to allow the administrator to maintain and manage operation.

The administrator can also input their own personal information and provide their own User Status Updates through the web network administrator screens. Through the web network, the administrator can also view broadcast message histories, alter general settings and office location information, update emergency information and update company emergency information. From the IVR network, the administrator can edit the messages the users hear, such as the reception message regarding DRS activation. Administrators can also listen to a user report on the IVR network providing information on the number of total registered users, the number who have replied OK, the number who have replied Not OK, and the number who have not yet replied.

All users have access to the Emergency Information Bulletin Board and the Company Information Bulletin Board. The Emergency Information Bulletin Board provides an area to post information or instructions viewable by all users. The Company Information Bulletin Board provides an area to record critical information, such as contact information, that may be needed by the users during a disaster.

Figure 3A:
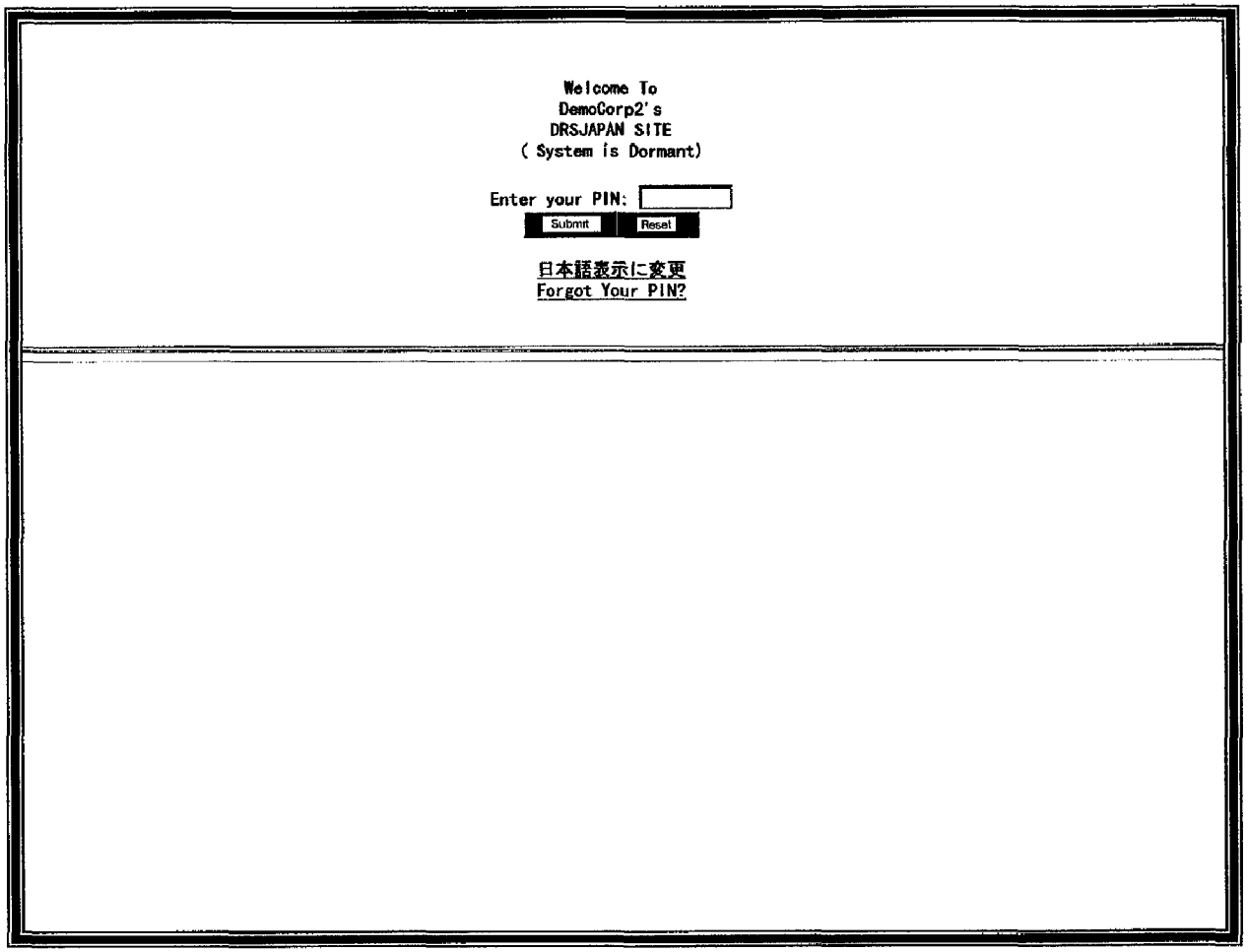
FIGS. 3A–3O show examples of computer screens for an administrator interface for a disaster recovery virtual roll call and recovery management system made in accordance with the present invention.
Figure 3B:
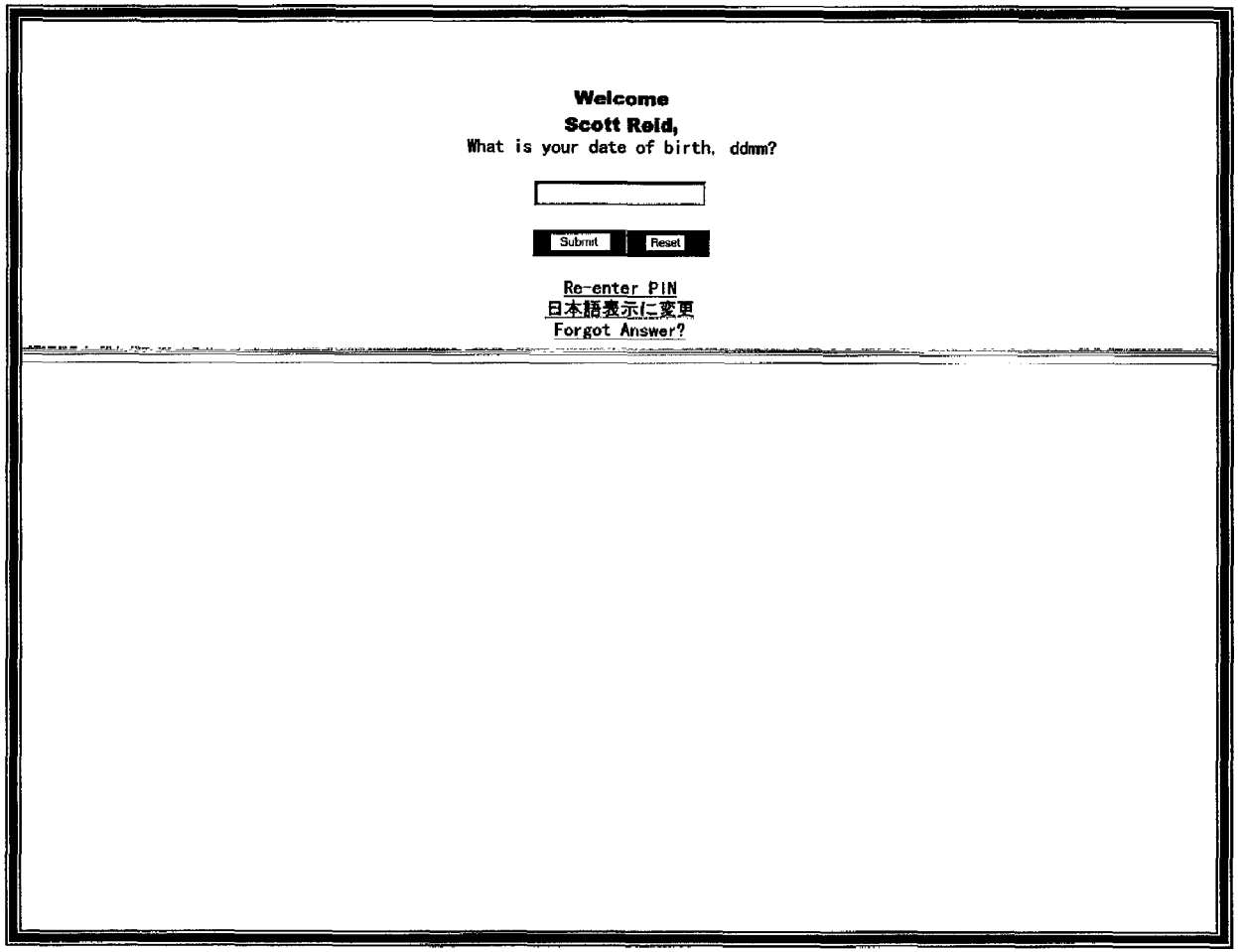
Figure 3C:
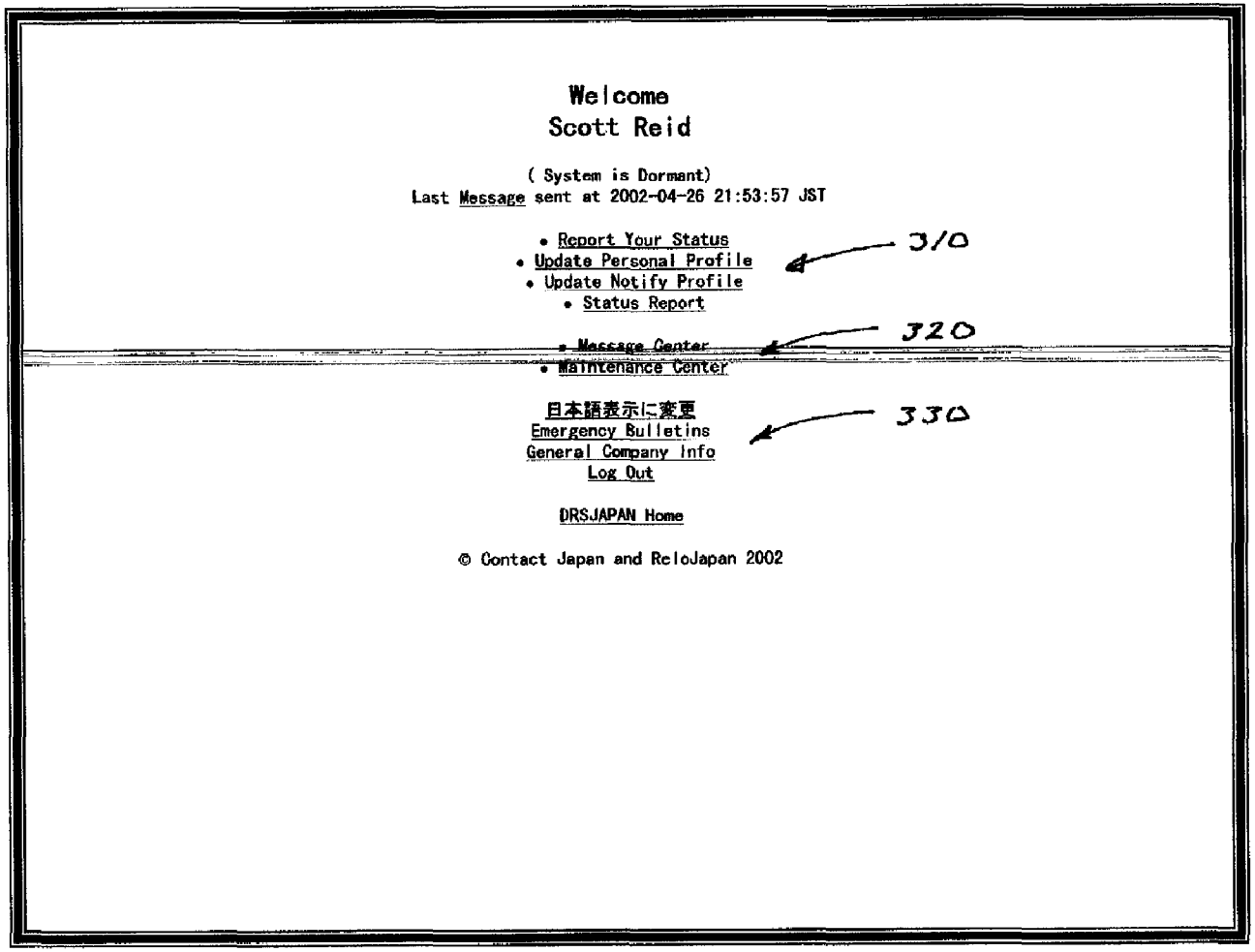

FIGS. 3A–3F show examples of computer screens for an administrator interface for a disaster recovery virtual roll call and recovery management system. The various screen options can be hyperlinked so the administrator can move easily from one screen to the next. FIG. 3A shows a log in screen for entering a PIN number. FIG. 3B shows a confirmation screen for answering a secret question to confirm identity. FIG. 3C shows an administrator screen allowing an administrator to manage personal information 310, access emergency and company information 330, and access the administrator message and maintenance screens 320. The management of personal information and access to emergency and company information are discussed in conjunction with the user screens, FIGS. 4A–4E below.

Figure 3D:
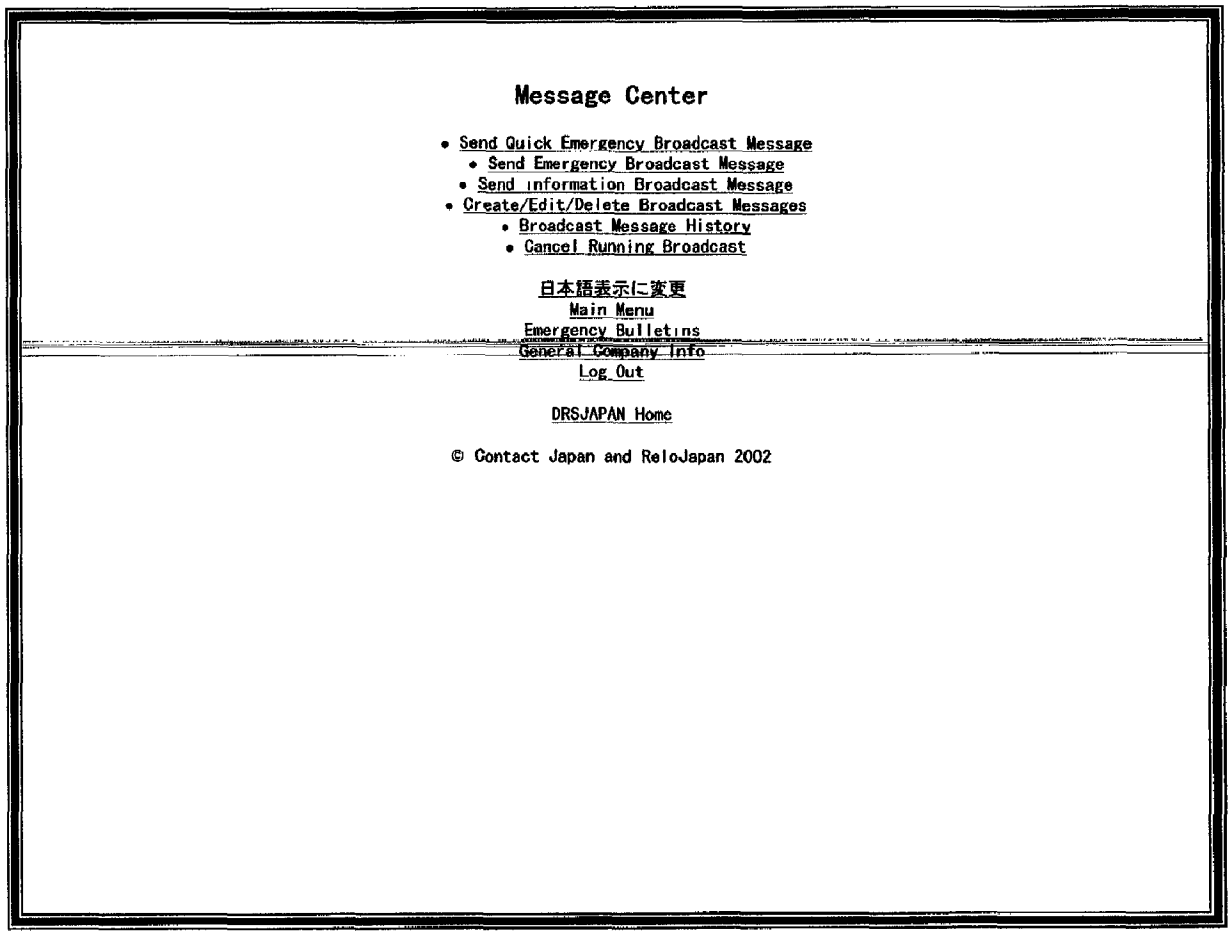
Figure 3E:
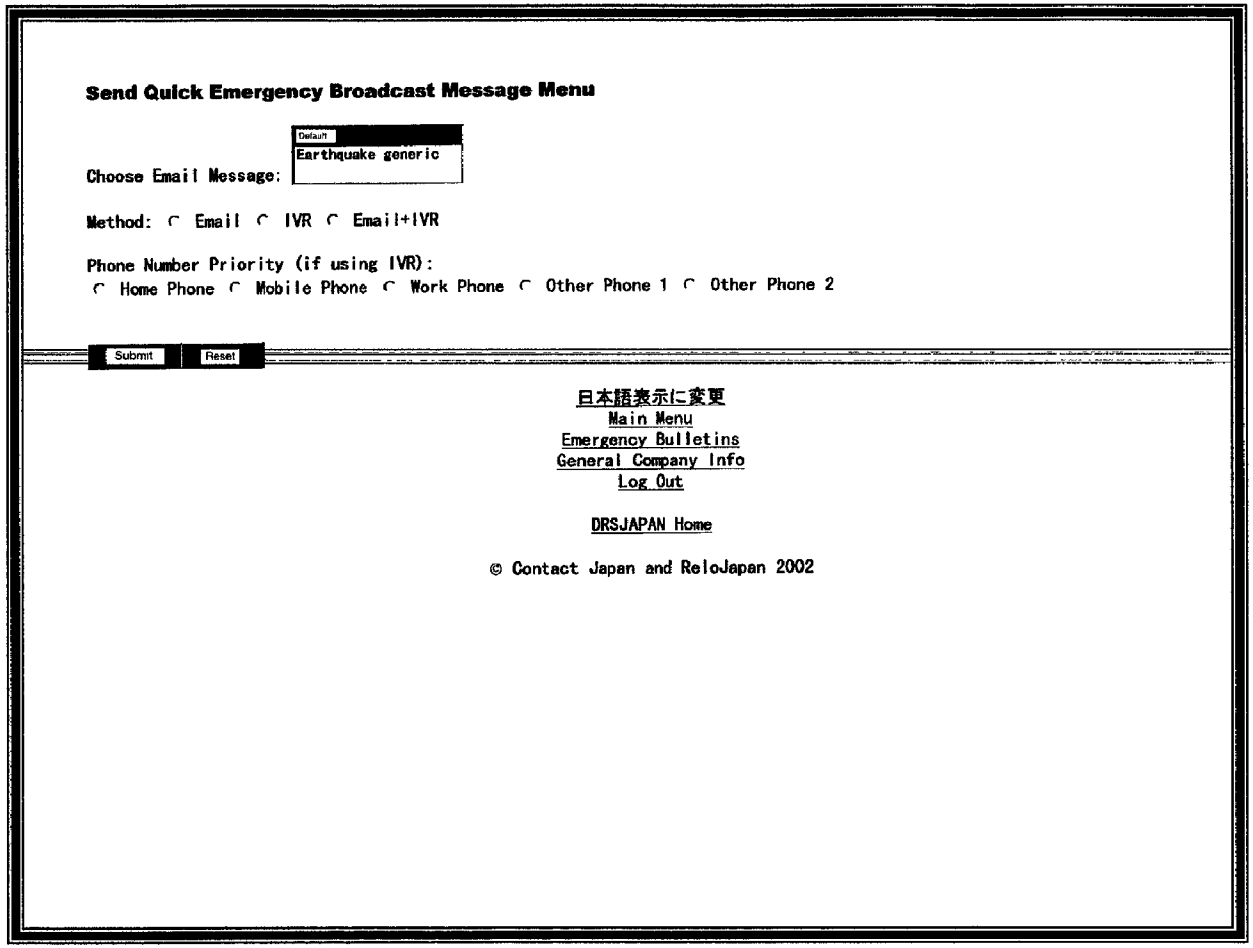

FIG. 3D shows an administrator message screen providing the options of sending Quick Emergency, Emergency, and Information Broadcast Messages. From the administrator message screen, the administrator can also create and edit messages, access the message history and cancel running broadcasts. The message history can include information such as the message type, time sent, and by whom, sending method (UVR, electronic mail, both), priority telephone number type selected for IVR, message name with links to text/voice message, and when the broadcast was terminated and by whom. FIGS. 3E, 3F, and 3G show examples of the options available when sending the Quick Emergency, Emergency, and Information Broadcast Messages, respectively.

Figure 3H:
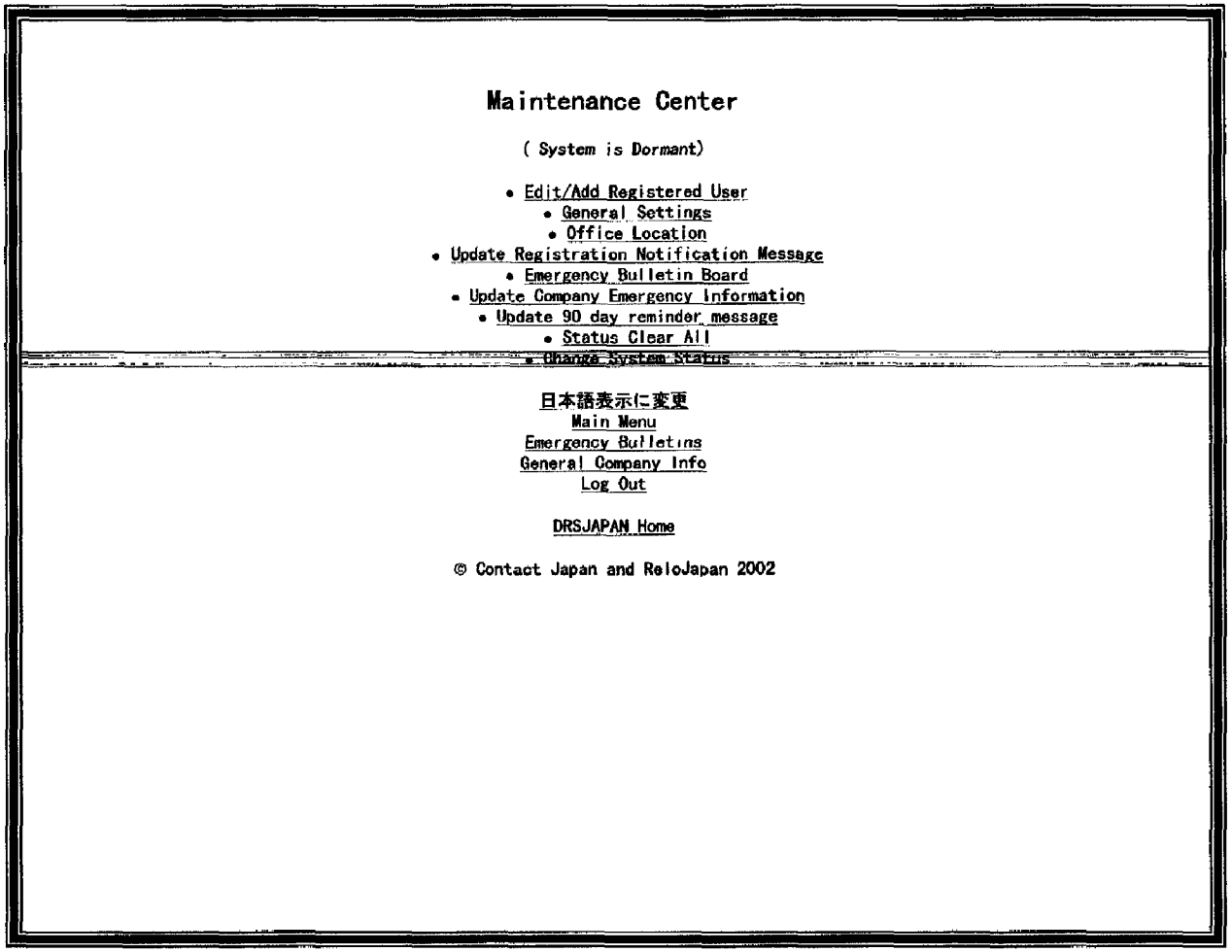
Figure 3J:
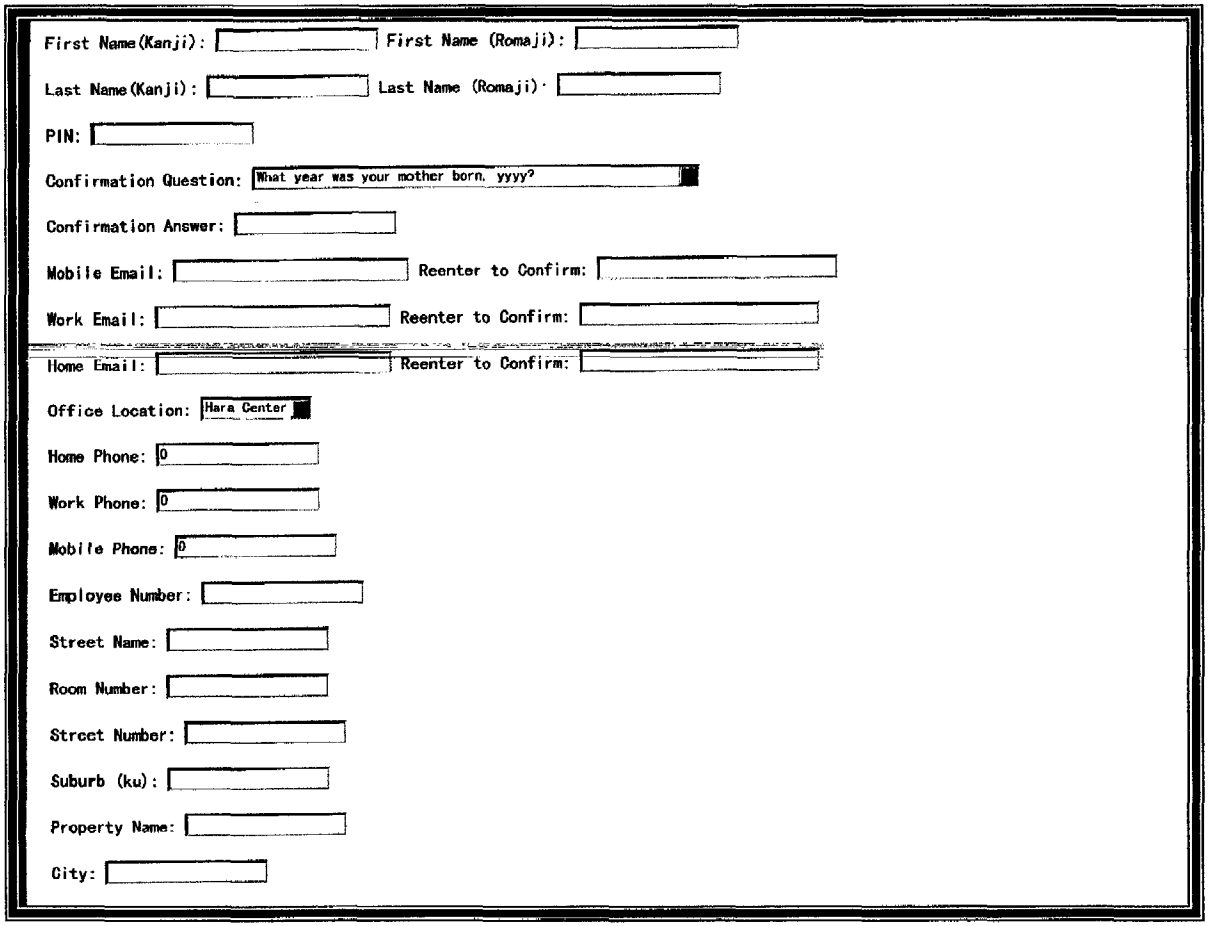
Figure 3K:
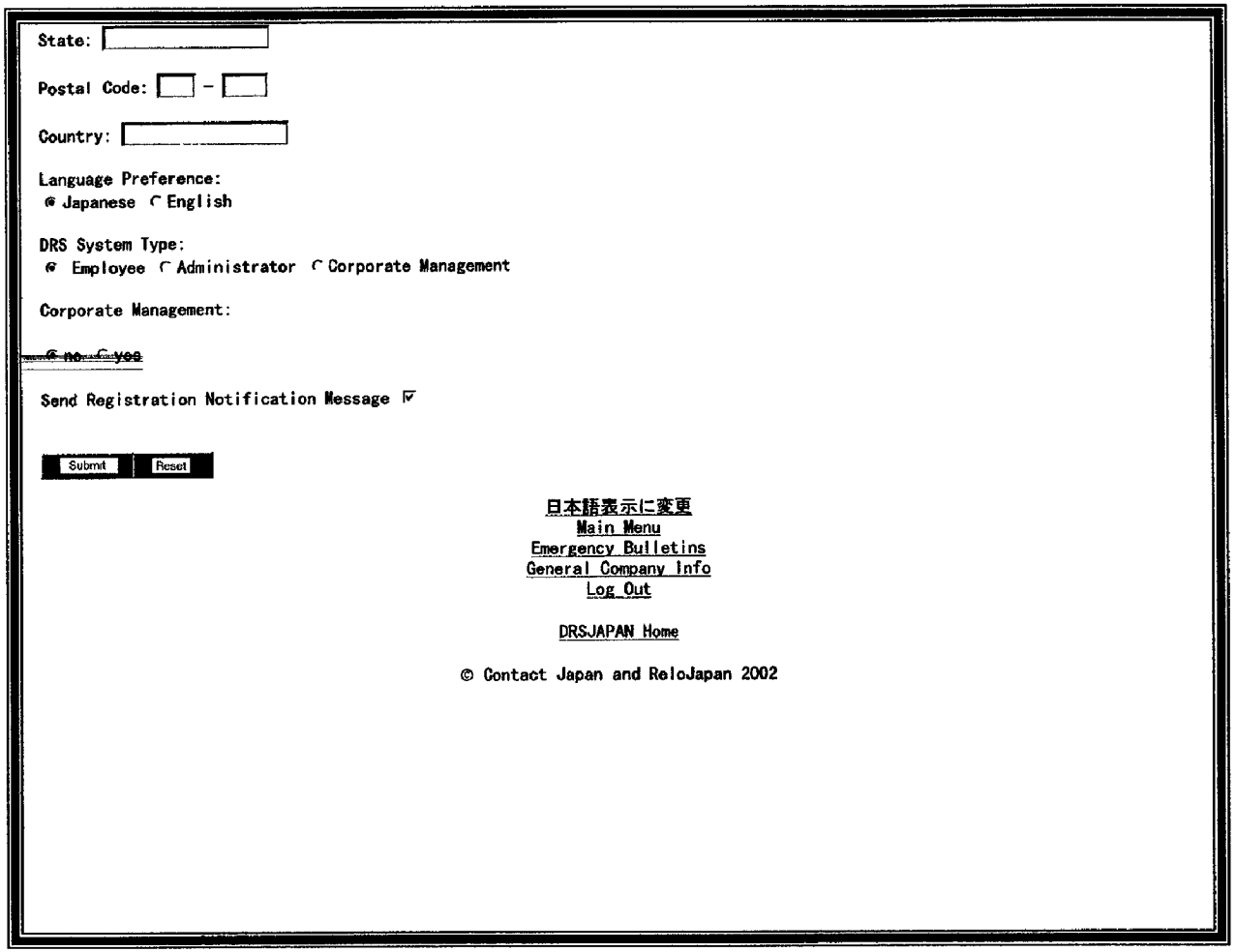
Figure 3L:
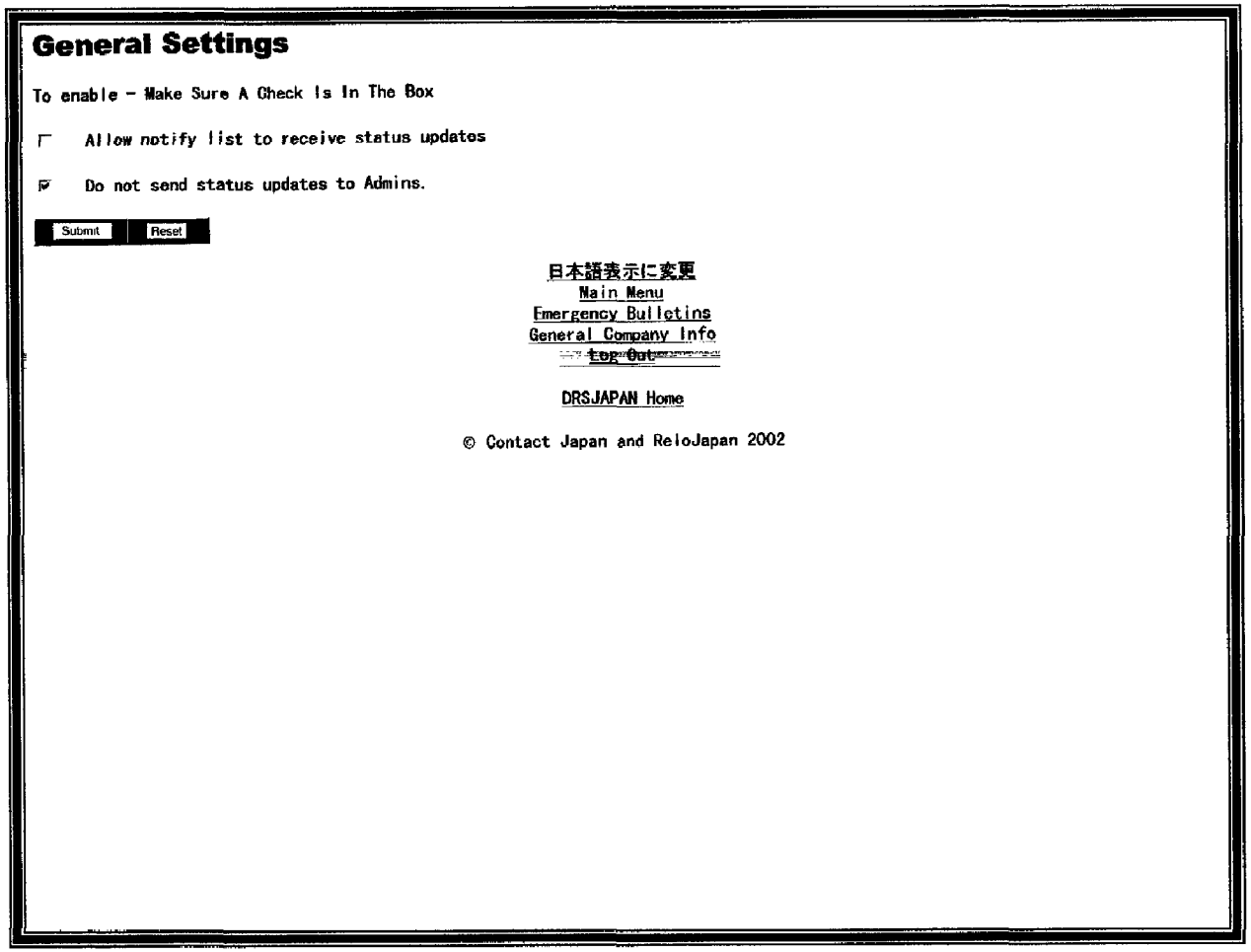
Figure 3M:
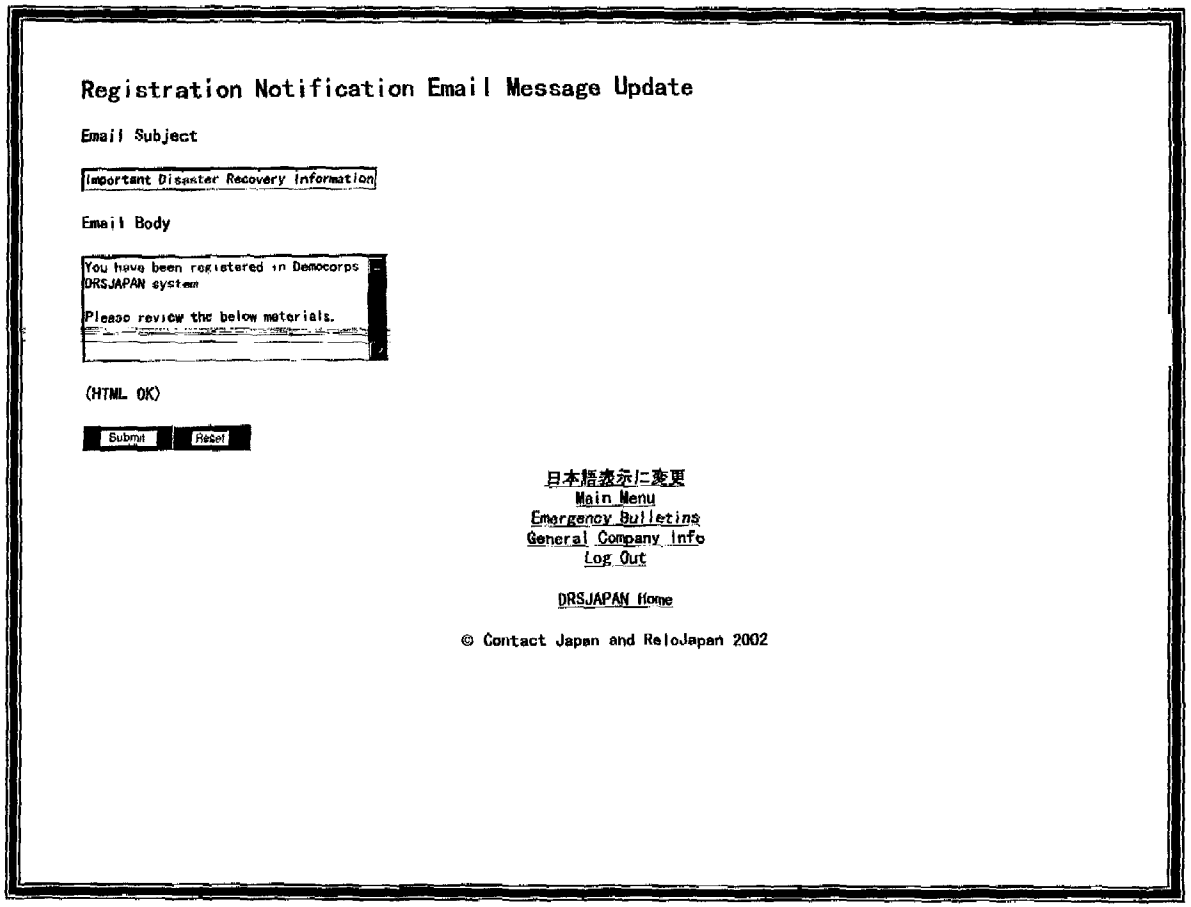
Figure 3N:
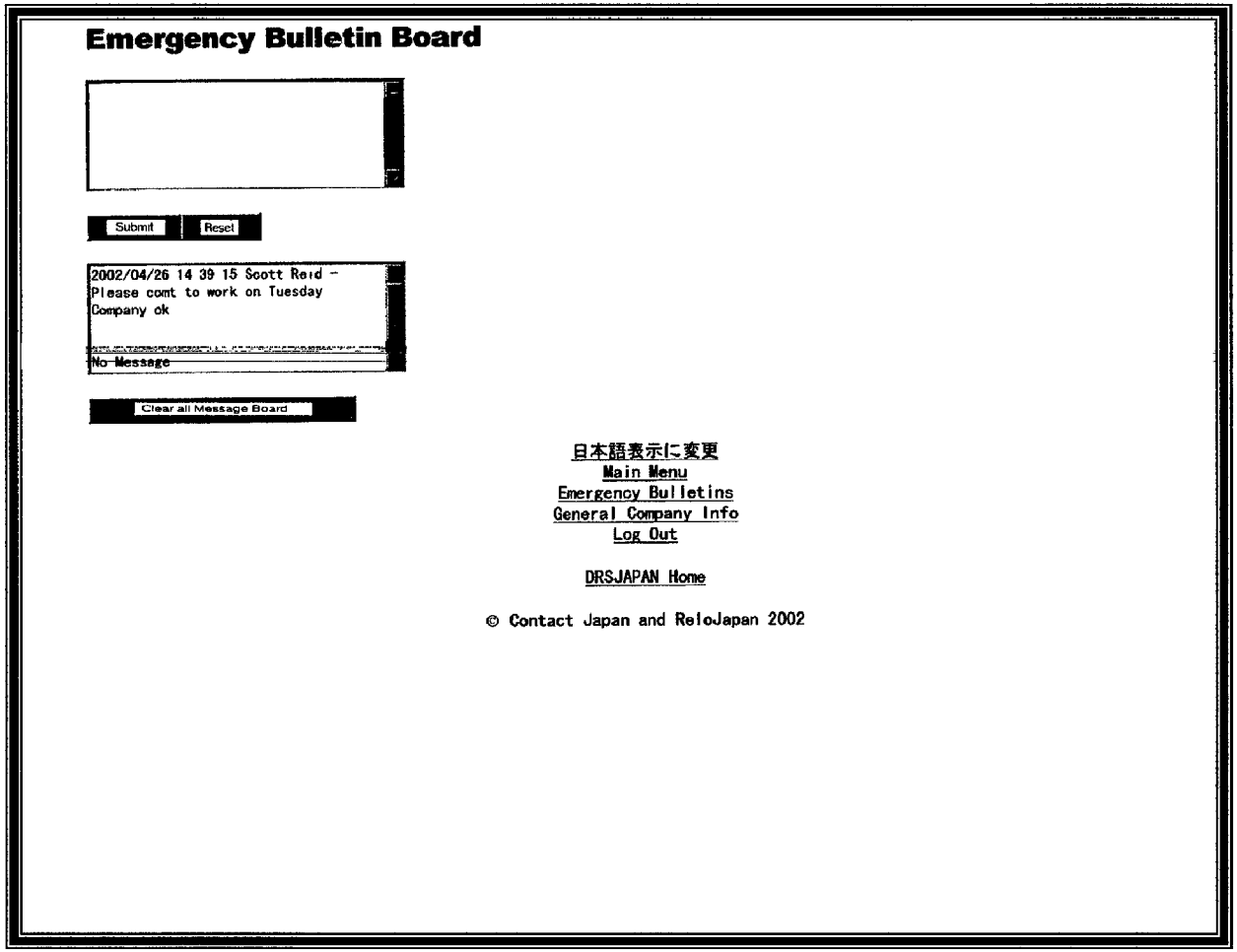
Figure 30:
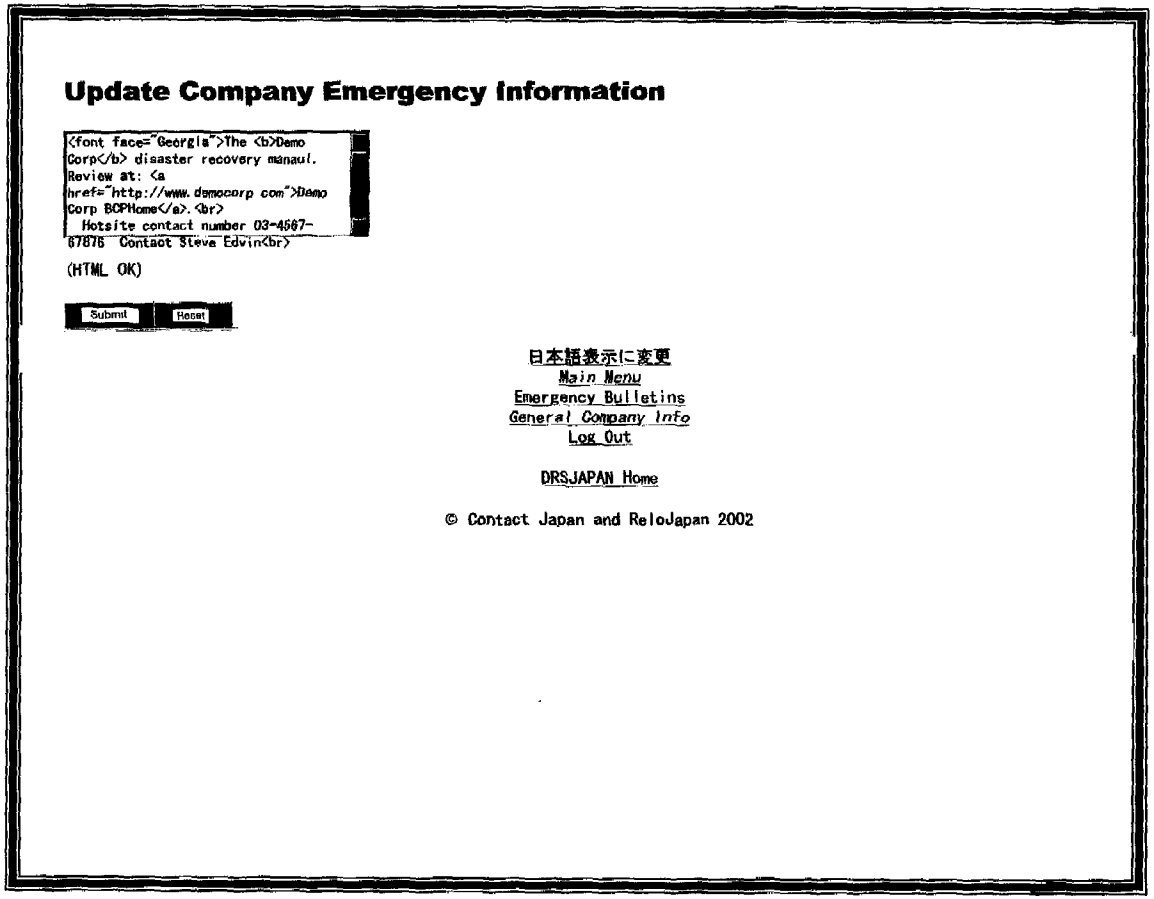

FIG. 3H shows an administrator maintenance screen, which allows the administrator to update information and manage the DRS. FIG. 31 shows the list of employees for editing or adding registered users, including user PIN and confirmation question information. FIGS. 3J & 3K show typical personal profile information fields for each registered user. FIG. 3L shows a screen for general settings with the options of forwarding status updates to the notify list and to the administrator. FIG. 3M shows a screen for editing the user notification email message to remind users to review and update their personal profile information. FIGS. 3N & 3O show examples of the options available when sending the Quick Emergency Bulletin Board and Company Information, respectively.

Figure 4A:
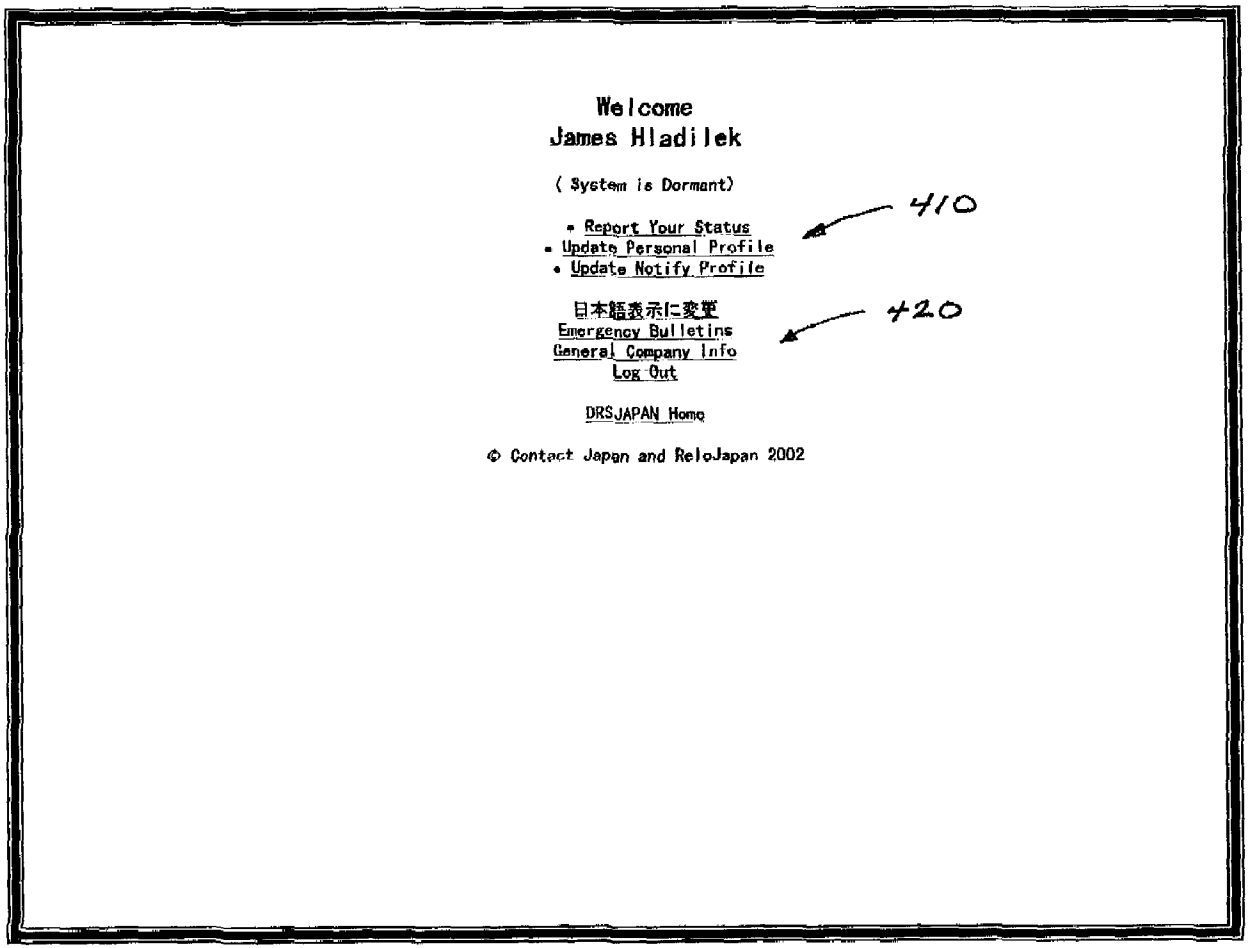
Figure 4B:
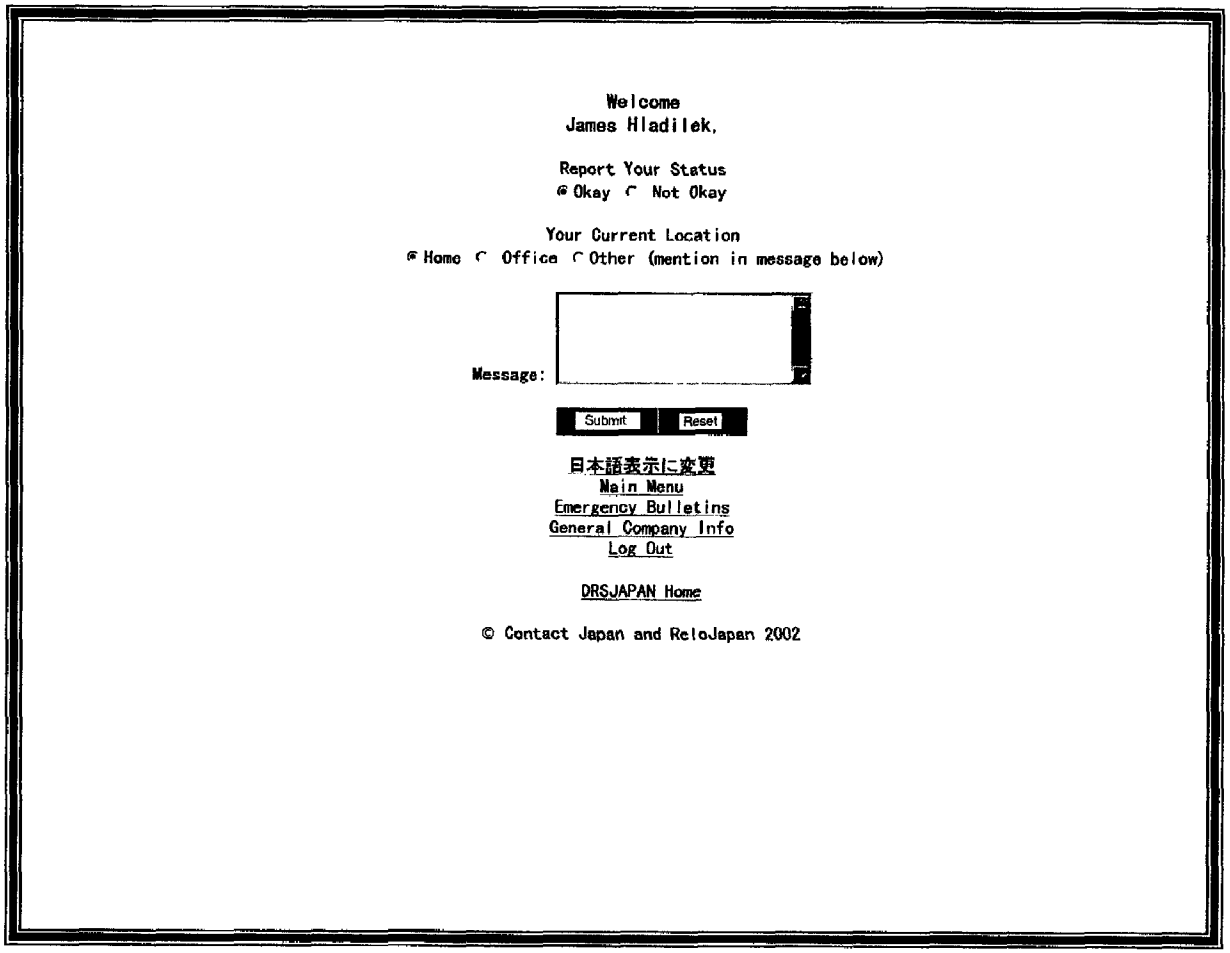
Figure 4D:
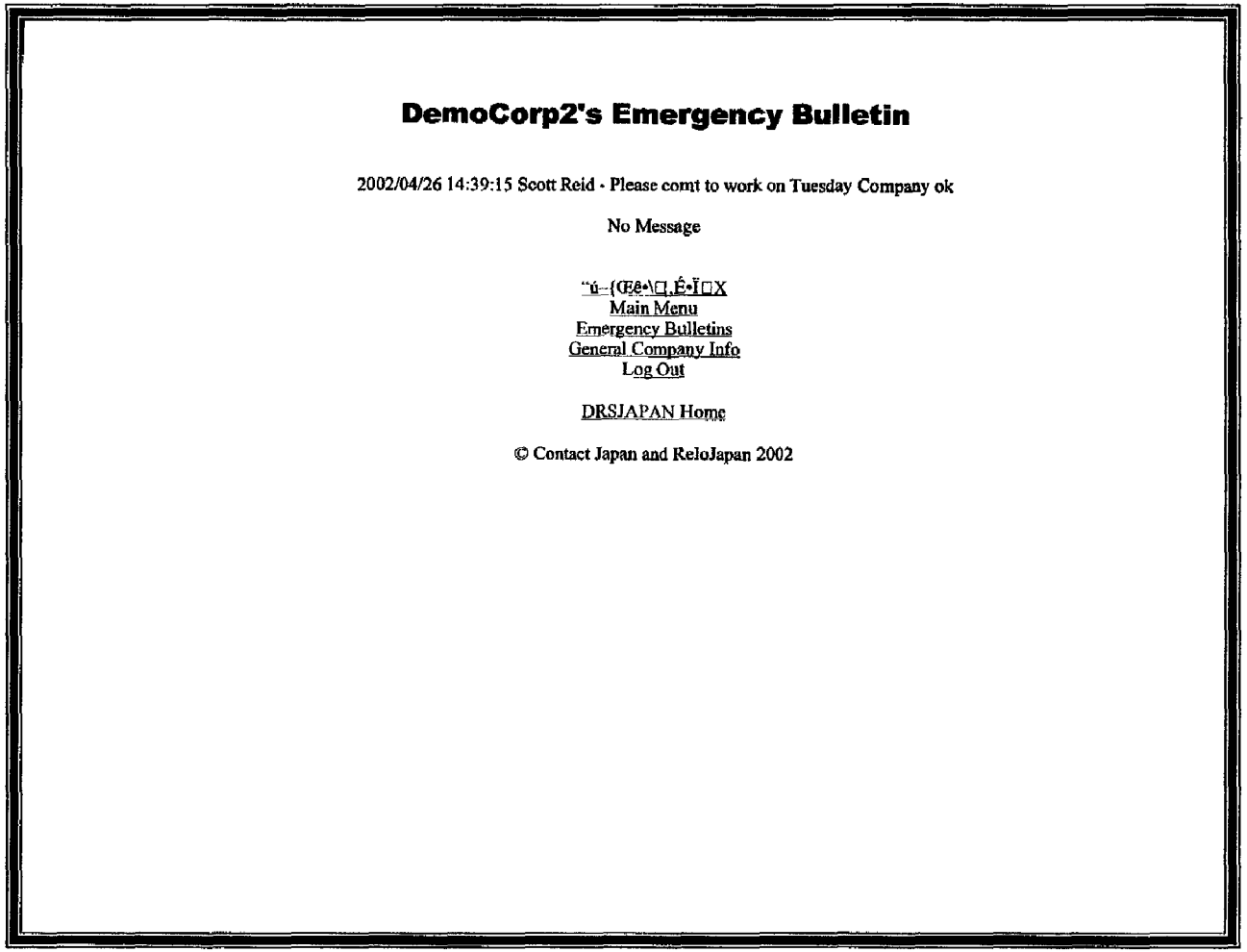
Figure 4E:
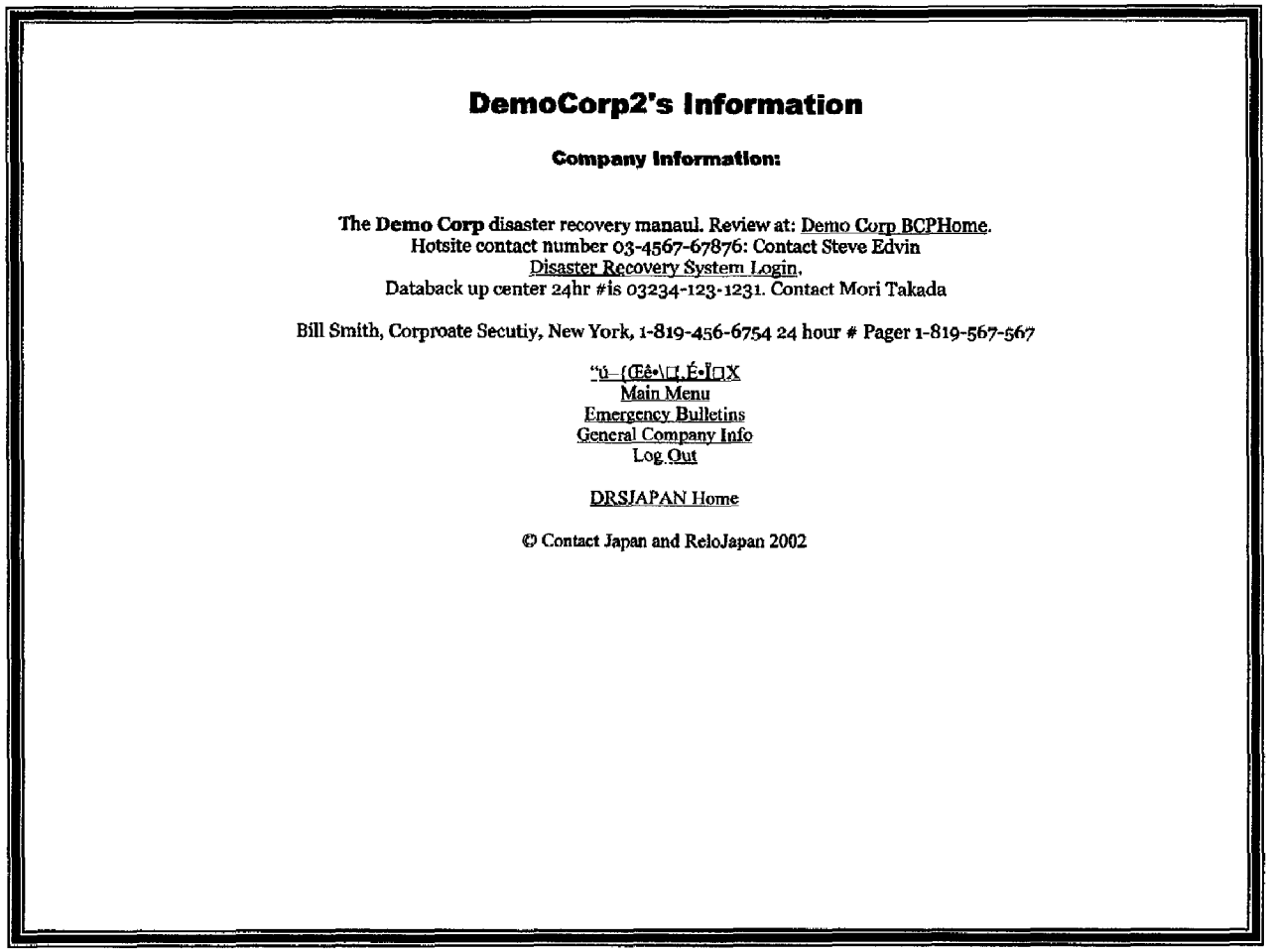

FIGS. 4A–4E show examples of computer screens for a user interface for a disaster recovery virtual roll call and recovery management system made in accordance with the present invention. The various screen options can be hyperlinked so the administrator can move easily from one screen to the next. FIG. 4A shows a user screen allowing a user to manage personal information 410, and access emergency and company information 420. The user reaches the user screen by entering a PIN number and answering a confirmation question as shown for the administrator in FIGS. 3B & 3C above. From the user screen, the user can enter and update their personal information as shown in FIGS. 3J & 3K above. FIG. 4B shows a User Status Update screen allowing the user to provide status in the case of an emergency. FIG. 4C shows a Notify List screen, which allows the user to enter and update email addresses of friends or families to whom the user would like an email sent when the user updates their status in the event of a disaster. FIG. 4D shows an Emergency Bulletin board screen providing information or instructions viewable by all users. FIG. 4E shows a General Company Information screen providing critical information, such as contact information, which may be needed by administrators during a disaster when access to their own computer system may not be possible due to the disaster.

Figure 5:
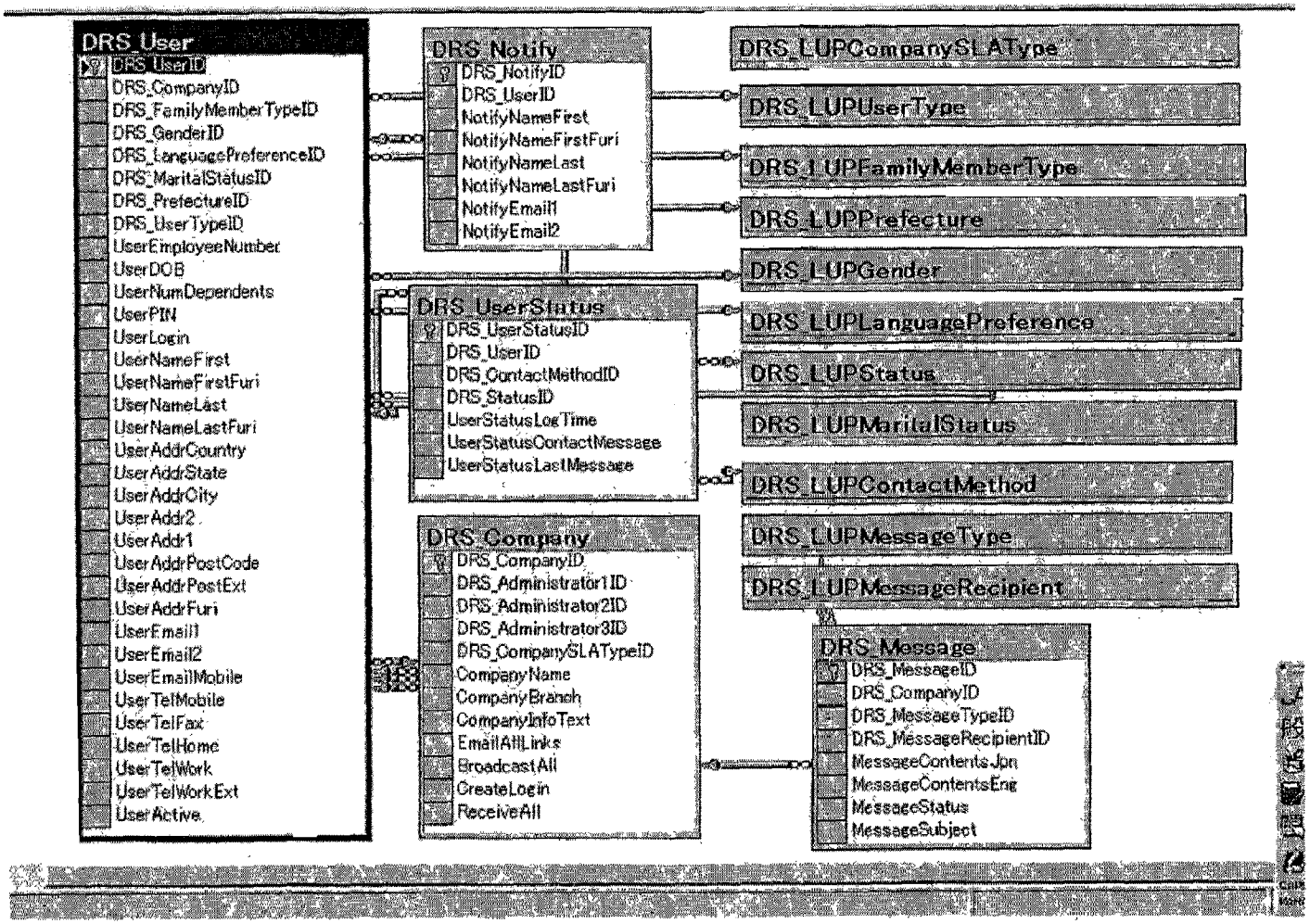
FIG. 5 shows an example of a database structure for a disaster recovery virtual roll call and recovery management system made in accordance with the present invention.

FIG. 5 shows an example of a database structure for a disaster recovery virtual roll call and recovery management system. Personal Profile Information (DRS_UserID, DRS_CompanyID, DRS_FamilyMemberTypeID, etc.) is provided for a particular user. The information in the DRS_Notify table provides columns for the Notify List of email addresses of friends or families to whom the user would like an email sent when the user updates their status in the event of a disaster. The information in the DRS_UserStatus table provides columns for the user status as supplied in the User Status Update. The information in the DRS_Company table provides columns for company data, including administrator information. The information in the DRS_Message table provides columns for messages, such as Emergency and Information Broadcast Messages.

It is important to note that FIGS. 1–6 illustrate specific applications and embodiments of the present invention, and are not intended the limit the scope of the present disclosure or claims to that which is presented therein. Many of the various steps can be performed in different orders without departing from the spirit of the invention. The present invention can also be used with different hardware and for different applications. For example, the computer networks can be multiple computer networks, distributed geographically or by function. Internet connections can be made with any device capable of connecting to the internet, including devices under development, such as two ways pagers, internet enable watches, internet enabled clothing, internet enabled household appliances, and the like. The internet enabled devices, particularly the mobile internet devices, can include Global Positioning System (GPS) circuits to pinpoint the location of the device and can supply the location information to the DRS to aid in locating users.

In addition, the DRS can be used in non-emergencies when it is critical that information be distributed to multiple users and the users must respond quickly to the information. The administrator can formulate a question with a group of appropriate answers and broadcast the question and answers to the users. The users select an answer and reply. This provides the capability to quickly survey the users on a particular matter. The DRS can also be used by various classes of users. The user can be an employee and the employer can use the DRS to check on employees, or the user can be a family member and family members can use the DRS to check on each other. Upon reading the specification and reviewing the drawings hereof, it will become immediately obvious to those skilled in the art that myriad other embodiments of the present invention are possible, and that such embodiments are contemplated and fall within the scope of the presently claimed invention.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. A disaster recovery virtual roll call and recovery management system, comprising:

a plurality of computer networks, each computer network operably connected to at least one other computer network, each computer network having database storage;

a plurality of communication networks, each communication network operably connected to at least one of the plurality of computer networks;

wherein the database storage for each of the plurality of computer networks stores user contact information and user status information for a user, at least one of the plurality of computer networks contacts the user through at least one of the plurality of communication networks according to the user contact information in case of disaster, and the user status information is updated by the user through at least one of the plurality of communication networks.

2. The system of claim 1 wherein the plurality of computer networks are connected through the internet.

3. The system of claim 1 wherein the plurality of computer networks comprises a first computer network and a second computer network, the first computer network remotely located from the second computer network.

4. The system of claim 1 wherein the user contact information on the plurality of computer networks is synchronized.

5. The system of claim 1 wherein the user status information on the plurality of computer networks is synchronized.

6. The system of claim 1 wherein the plurality of computer networks are selected from the group consisting of web networks and Interactive Voice Response (IVR) networks.

7. The system of claim 1 wherein the communication networks are selected from the group consisting of telephone connections and internet connections.

8. The system of claim 7 wherein the telephone connections are selected from the group consisting of standard telephones and wireless telephones.

9. The system of claim 7 wherein the internet connections are selected from the group consisting of internet enabled personal computers, internet enabled wireless devices, internet enabled telephones, handheld portable computers with a wireless internet connection, and notebook portable computers with a wireless internet connection.

10. The system of claim 7 wherein at least one of the internet connections includes a global positioning circuit.

11. A disaster recovery virtual roll call and recovery management method comprising:

storing personal profile information comprising user contact information and user status information on a plurality of computer networks;

sending an emergency broadcast message to users according to the user contact information over at least one communication network, the emergency broadcast message requesting the users to update their status information;

receiving updated user status information on at least one of the plurality of computer networks;

compiling the updated user status information; and generating user status reports from the personal profile information.

12. The method of claim 11 further comprising synchronizing the user contact information and the user status information on the plurality of computer networks.

13. The method of claim 11 wherein the plurality of computer networks are selected from the group consisting of web networks and Interactive Voice Response (IVR) networks.

14. The method of claim 11 wherein the communication network is selected from the group consisting of telephone connections and internet connections.

15. The method of claim 14 wherein the telephone connections are selected from the group consisting of standard telephones and wireless telephones.

16. The method of claim 14 wherein the internet connections are selected from the group consisting of internet enabled personal computers, internet enabled wireless devices, internet enabled telephones, handheld portable computers with a wireless internet connection, and notebook portable computers with a wireless internet connection.

17. The method of claim 14 wherein the updated user status information includes user location information.

18. The method of claim 11 wherein sending an emergency broadcast message to users according to the user contact information over at least one communication network further comprises:

selecting an emergency broadcast message mode; and sending the emergency broadcast message according to the emergency broadcast message mode.

19. The method of claim 18 wherein the emergency broadcast message mode is selected from the group consisting of quick send mode and detailed send mode.

20. The method of claim 11 further comprising:

storing third party notification information on at least one of the plurality of computer networks; and sending user status information to third parties according to the third party notification information.

21. The method of claim 11 wherein generating user status reports from the personal profile information further comprises generating a transactional report when updated user status information is received.

22. The method of claim 11 wherein generating user status reports from the personal profile information further comprises generating an analytic report, the analytic report comprising a general status report and links to detailed status reports.

23. The method of claim 11 further comprising sending an information broadcast message to users according to the user contact information.

24. A disaster recovery virtual roll call and recovery management system comprising:

means for storing personal profile information comprising user contact information and user status information on a plurality of computer networks;

means for sending an emergency broadcast message to users according to the user contact information over at least one means for communicating, the emergency broadcast message requesting the users to update their status information;

means for receiving updated user status information on at least one of the plurality of computer networks;

means for compiling the updated user status information;

means for generating user status reports from the personal profile information.

25. The system of claim 24 further comprising means for synchronizing the user contact information and the user status information on the plurality of computer networks.

26. The system of claim 24 wherein means for sending an emergency broadcast message to users according to the user contact information over at least one means for communicating further comprises:

means for selecting an emergency broadcast message mode; and means for sending the emergency broadcast message according to the emergency broadcast message mode.

27. The system of claim 24 further comprising:

means for storing third party notification information on at least one of the plurality of computer networks; and means for sending user status information to third parties according to the third party notification information.

28. The system of claim 24 wherein means for generating user status reports from the personal profile information further comprises means for generating a transactional report when updated user status information is received.

29. The system of claim 24 wherein means for generating user status reports from the personal profile information further comprises means for generating an analytic report, the analytic report comprising a general status report and links to detailed status reports.

30. The system of claim 24 further comprising means for sending an information broadcast message to users according to the user contact information.

31. The system of claim 24 further comprising means for pinpointing user location.

32. The system of claim 1 wherein the plurality of computer networks are geographically distributed.

33. The system of claim 1 wherein at least one of the plurality of computer networks is geographically distributed from at least one of the plurality of communication networks.

* * * * *